US006447095B1

(12) United States Patent
Kanda et al.

(10) Patent No.: US 6,447,095 B1
(45) **Date of Patent: *Sep. 10, 2002**

(54) DISCHARGE RECOVERY METHOD FOR INK JET APPARATUS USING WATERPROOF INK AND INK JET APPARATUS EMPLOYING THE METHOD

(75) Inventors: Hidehiko Kanda, Yokohama; Hisao Yaegashi, Kawasaki; Masao Kato, Yokohama, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/442,769

(22) Filed: May 17, 1995

(30) Foreign Application Priority Data

May 24, 1994 (JP) ..... 6-109406
May 19, 1994 (JP) ..... 6-105298

(51) Int. Cl.[7] ..... D41J 2/165

(52) U.S. Cl. ..... 347/30; 347/29; 347/32; 347/44; 347/100

(58) Field of Search ..... 347/30, 29, 35, 347/60, 23, 33, 32, 19, 87, 100, 44, 45, 47

(56) References Cited

U.S. PATENT DOCUMENTS 4,454,519 A * 6/1984 Oosaka et al. ..... 347/45
4,890,126 A * 12/1989 Hotomi ..... 347/45
4,967,204 A * 10/1990 Terasawa et al. ..... 347/30
5,342,440 A * 8/1994 Wickramanayke ..... 106/22 R
5,355,158 A * 10/1994 Inada et al. ..... 347/4
5,406,317 A * 4/1995 Shimamura et al. ..... 347/23
5,479,196 A * 12/1995 Inada ..... 347/92
5,543,826 A * 8/1996 Kuronuma et al. ..... 347/23
5,571,313 A * 11/1996 Mafune et al. ..... 347/100
5,592,200 A * 1/1997 Kaneko ..... 347/30
5,949,454 A * 9/1999 Nozawa et al. ..... 347/45

FOREIGN PATENT DOCUMENTS

DE 4207625 A1 * 9/1993
DE 004210161 A1 * 9/1993 ..... 347/68
EP 0 551 752 A2 * 12/1992 ..... B41J/2/165
JP 06191033 A * 7/1994
JP 406191034 A * 7/1994 ..... 347/56

* cited by examiner

*Primary Examiner*—John Barlow
*Assistant Examiner*—Shih-wen Hsieh
(74) *Attorney, Agent, or Firm*—Fitzpatrick, Cella, Harper & Scinto

(57) ABSTRACT

A system using discharge orifices having waterproof ink orifices for discharging waterproof ink which becomes water insoluble after drying and non-waterproof ink orifices for discharging non-waterproof ink, a cap for covering the discharge orifices, and a suction device for effecting suction through the discharge orifices when the cap covers the discharge orifices. The system includes covering both the waterproof ink orifices and the non-waterproof ink orifices collectively by the cap, effecting suction through both the waterproof ink orifices and the non-waterproof ink orifices by driving the suction device when the cap covers both the waterproof ink orifices and the non-waterproof ink orifices collectively, discharging, after sucking, both the waterproof ink orifices and the non-waterproof ink orifices into the cap, and exhausting, after discharging, ink out of the cap by driving the suction means when an inside of the cap communicates with air.

93 Claims, 14 Drawing Sheets

DISCHARGE RECOVERY METHOD FOR INK JET APPARATUS USING WATERPROOF INK AND INK JET APPARATUS EMPLOYING THE METHOD

BACKGROUND OF THE INVENTION

1. Field of the Invention

The present invention relates to an ink jet recording apparatus having an ink jet head for use in the recording or printing (hereinafter referred to as "recording") of characters, symbols or images (hereinafter typically referred to as "image") by discharging the ink or functional liquid (hereinafter typically referred to as "ink") onto the recording carrier such as the paper, plastic sheet, cloth, article and so on (hereinafter typically referred to as "paper"), or an ink jet pen containing an ink reservoir for reserving the ink to be supplied to the ink jet head. This invention also relates to an operation method for the ink jet apparatus.

By the ink jet pen as herein used is meant encompassing both the cartridge form having an ink jet head and an ink reservoir integrally provided and the form having them separately provided to be detachable. This ink jet pen can be freely attached to or detached from mounting means such as a carriage on the main unit of the apparatus. Also, by the ink jet apparatus as herein used is meant encompassing a variety of forms including those integrally or separately provided as the output terminal for the information processing equipment such as a word processor or a computer, a copying machine combined with an information reader, a facsimile apparatus having the information transmission or reception feature, and a machine for the textile printing onto the cloth.

2. Related Background Art

In the ink jet recording apparatus, when the apparatus is not used for a long time, the water content or other volatile components within the nozzles (hereinafter also referred to as "discharge orifices") may vaporize to cause the viscosity of the ink to increase or bubbles to mix into the nozzles or ink flow passageways, thereby impeding the ink from being excellently discharged. In order to recover such ink condition to original excellent condition for the ink discharge, the ink jet recording apparatus is often provided with some recovery means. One example of such recovery means may include a suction mechanism for sucking the ink from the nozzles when a cap covers the nozzles, and supplying the new ink from an ink tank to a head. Typical elements constituting such suction mechanism include a cylinder pump for generating pressure changes by the use of the relative movement between the cylinder and the piston, and a tube pump for generating pressure changes by stroking the tube.

In such ink jet recording apparatus, it was apprehended that if the ink dries inside of a suction mechanism, that is, inside of a cap, a pump, an ink suction passageway leading from the cap to the pump, or a waste ink flow passageway leading from the pump to a waste ink reservoir, the dried ink may cause an inconvenience of blocking the flow of the ink. For example, it was apprehended that if the ink solidifies within the pump, the pump may be possibly stopped. Or it was apprehended that the ink solidifies inside the waste ink flow passageway and is impeded from flowing, though the ink is essentially directed into the waste ink reservoir, so that the ink is reversely flowed to the head side to make worse the discharge characteristics, thereby having adverse effect on the recording quality, or the ink will overflow from unexpected portion into the apparatus to contaminate the apparatus inside or have detrimental effect on the electric circuit within the apparatus.

Such problems also exist on the side of the ink jet head. For example, a typical example of the ink jet pen as previously described includes a form in which an ink jet head and an ink reservoir for reserving the ink to be supplied to the head are integrated together detachably. The ink jet head is provided with discharge orifices for discharging the ink, and also electrothermal converters to generate the heat energy, for example, as the energy used to discharge the ink from the discharge orifices. The ink reservoir mostly contains a porous absorbing member for reserving the ink. The ink supply passageway for communicating the ink jet head to the ink reservoir is commonly provided with a filter to trap the foreign matter such as dirt in the ink.

In the use of such ink jet pen, when the ink reservoir was not attached to the ink jet head for a long time, it occurred that ink components vaporized from the filter portion of ink supply passageway or discharge orifices to cause the ink to solidify and be fixed to the wall surface of ink passageway. There was a problem that once such ink fixing occurs, the supply of the ink is impeded by fixed ink and the discharge of the ink becomes bad even if the ink reservoir is attached again to the ink jet head.

The above-mentioned technical problem is more remarkable in the case of using the waterproof ink which becomes water insoluble after drying. The waterproof ink which becomes water insoluble after drying can meet a recent technical demand of improving the waterproofness of recorded image, but on the other hand, has brought about a new technical problem that the ink is more likely to fix in the interior of the apparatus. That is, this is a technical problem that such waterproof ink is liable to fixing in the interior of the recovery mechanism or the ink passageways of the ink jet head.

SUMMARY OF THE INVENTION

An object of the invention is to resolve the aforementioned technical problem, and to provide an ink jet apparatus and its operation method which is capable of maintaining the stable recording condition for the long term, because the ink fixing does not occur in the ink channels or can be removed promptly, even if it occurs.

It is another object of the invention to provide an ink jet apparatus and its operation method which is capable of maintaining the stable recording condition for the long term, because the ink fixing does not occur in the interior of a recovery mechanism or can be removed promptly, even if it occurs.

It is a further object of the invention to provide an ink jet apparatus and its operation method, wherein the ink fixing does not occur in the interior of a recovery mechanism for recovering an ink jet head using the waterproof inks of which at least one ink becomes water insoluble after drying, or can be removed promptly, if it occurs.

It is a still further object of the invention to provide a color ink jet apparatus and its operation method, wherein the ink fixing does not occur in the interior of a recovery mechanism for recovering an ink jet head using the waterproof inks of which at least one color ink becomes water insoluble after drying, or can be removed promptly, if it occurs, and wherein the color mixing is less likely to occur.

It is a yet further object of the invention to provide an ink jet apparatus and its operation method wherein even when an ink reservoir is not attached for a long time to an ink jet head using the waterproof ink which becomes water insoluble after drying, the ink fixing is less likely to occur in the ink passageways for the ink jet head, and the stable ink discharging is enabled immediately after attaching the ink reservoir.

It is another object of the invention to provide an operation method for an ink jet recording apparatus comprising a cap for covering the discharge orifices for discharging the ink, and suction means for effecting suction through said discharge orifices when said cap covers said discharge orifices, characterized by including in sequence:

a suction process of effecting suction through said discharge orifices by driving said suction means when said cap covers said discharge orifices;

a discharge process of discharging the ink from said discharge orifices into said cap; and an exhausting process of exhausting the ink out of said cap.

It is another object of the invention to provide an operation method for an ink jet apparatus mounting an ink jet head provided with the discharge orifices for discharging the waterproof ink which becomes water insoluble after drying, and an ink reservoir for reserving said ink to be supplied to said ink jet head, characterized by including an exhausting process for exhausting said ink out of said ink jet head when said ink reservoir is attached.

It is another object of the invention to provide an ink jet apparatus characterized by comprising:

a cap for covering the discharge orifices for discharging the ink;

suction means for effecting suction from said discharge orifices when said cap covers said discharge orifices; and control means for making the control to effect suction from said discharge orifices by driving said suction means when said cap covers said discharge orifices, and discharge the ink from said discharge orifices into said cap to exhaust the ink cut of said cap.

It is another object of the invention to provide an ink jet apparatus having:

an ink jet head provided with the discharge orifices for discharging the waterproof ink which becomes water insoluble after drying;

an ink reservoir for reserving said ink to be supplied to said ink jet head; and control means for making the control to exhaust said ink out of said ink jet head when said ink reservoir is not attached.

The present invention has been achieved as a result of the careful researches by the present inventors to resolve the above-mentioned technical problem which is the fixing of the ink in the interior of the recovery mechanism, and especially a more remarkable technical problem which arises in the case of using the waterproof ink which becomes water insoluble after drying. That is, the present invention resides in preventing or removing the ink fixing within the recovery mechanism containing a cap by predischarging the ink into the interior of the cap after performing suction recovery via the cap, and thereafter evacuating the ink itself having caused the ink fixing from the inside of the recovery mechanism by exhausting the ink remaining inside the recovery mechanism by idle suction. In this case, with an ink jet apparatus using both the waterproof ink which becomes water insoluble after drying and the normal non-waterproof ink, even if the ink fixing occurs due to the waterproof ink, the non-waterproof ink will mix therein by predischarge, whereby the effects of the present invention of preventing or removing the ink fixing can be more remarkably exhibited.

Also, if using the inks of different colors as the waterproof ink which becomes water insoluble after drying and the normal non-waterproof ink, suction is performed via a cap collectively covering the discharge orifices for discharging the inks, the inks of different colors may be mixed within the cap, and reversely flowed into the discharge orifices, resulting in a technical problem of color mixing. However, according to the present invention, the technical problem of color mixing can be also resolved, because mixed color inks can be exhausted out of each discharge orifice by predischarging after suction.

According to the present invention, even when an ink reservoir is not attached for a long time to an ink jet head using the waterproof ink which becomes water insoluble after drying, the ink within the ink jet head can be exhausted, and therefore the ink fixing is less likely to occur in the ink passageways of the ink jet head, and the stable ink discharge is enabled immediately after attaching the ink reservoir.

By "suction" as herein used is meant that when the cap covers the discharge orifices, suction is performed via the cap from the discharge orifices by driving suction means represented by a pump. By "idle suction" as herein used is meant that when the cap opens the discharge orifices, or when the cap inside is communicating to the atmosphere by opening a valve in communication with the cap even if the cap covers the discharge orifices, suction is performed to draw the air into the inside of the recovery mechanism via the cap by driving suction means represented by the pump. Exhausted ink is finally conducted into a waste ink reservoir provided within the main unit, for example, and held not to leak outside. By "predischarge" as herein used is meant to perform the ink discharging into ink receiving means such as a cap, irrespective of the recording. By "wiping" as herein used is meant wiping out by a wiper blade normally made of an elastic material the foreign matter such as ink droplets or dirt adhering to the discharge orifice face on which discharge orifices of the ink jet head are provided.

Thus, according to the present invention, it is possible to resolve the above-described technical problem of ink fixing in the interior of the recovery mechanism, and especially a more remarkable technical problem when the waterproof ink which becomes water insoluble after drying is used.

Also, according to the present invention, since even when the color recording is performed, the mixed color inks can be exhausted out of each discharge orifice by predischarging after suction, the technical problem of color mixing can be resolved.

Further, according to the present invention, since even when an ink reservoir is not attached for a long time to an ink jet head using the waterproof ink which becomes water insoluble after drying, the ink within the ink jet head can be exhausted, the ink fixing is less likely to occur in the ink passageways of the ink jet head, and the stable ink discharge is enabled immediately after attaching the ink reservoir.

The above and other objects, effects, features, and advantages of the present invention will become more apparatus from the following description of embodiments thereof taken in conjunction with the accompanying drawings.

DETAILED DESCRIPTION OF THE EMBODIMENTS

The preferred embodiments of the present invention will be now described in detail.

Figure 1:
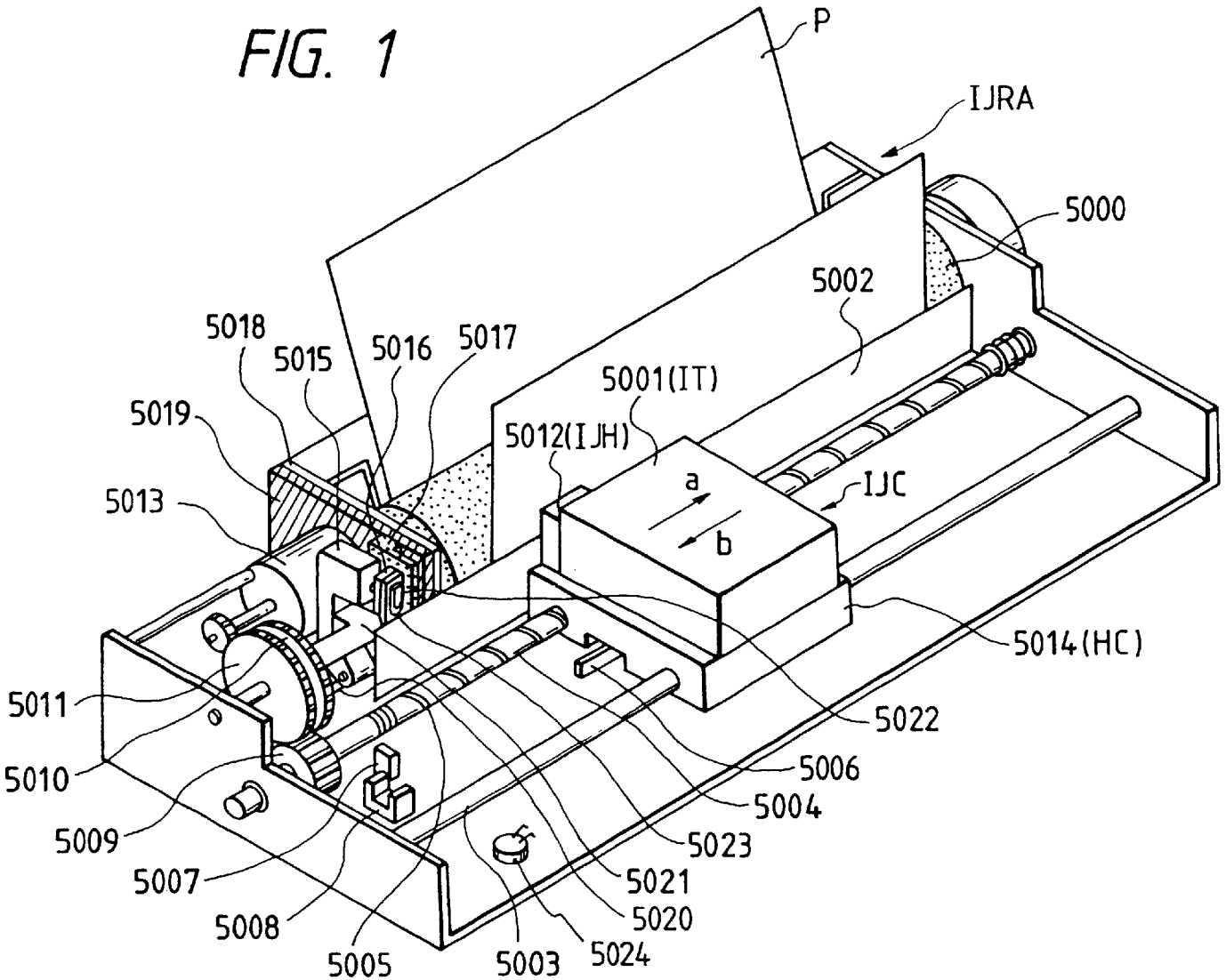
FIG. 1 is a perspective view showing the essence of an example of an ink jet recording apparatus suitable for applying the present invention thereto.

FIG. 1 is a perspective view showing the essence of an example of an ink jet recording apparatus (IJPA) suitable for applying the present invention thereto.

In FIG. 1, 5001 is an ink tank (IT), and 5012 is an ink jet recording head (IJH) coupled thereto. A replaceable ink jet cartridge of integral type (IJC) is formed of the ink tank 5001 and the recording head 5012. 5014 is a carriage (HC) which can move with the ink jet cartridge (IJC) mounted thereon, and 5003 is a guide for guiding the carriage (HC) in the main scan direction.

5000 is a platen roller for causing the recording medium as indicated by the symbol P to scan in the sub-scan direction. 5024 is a temperature sensor for measuring the ambient temperature within the apparatus. The carriage 5014 is connected with a flexible cable (not shown) for supplying a pulse signal current for driving or a heat temperature regulating current to the recording head 502. The flexible cable is connected with a printed board (not shown) comprising an electric circuit for controlling the apparatus. On this printed board, the temperature sensor 5024 such as e.g. a thermistor is attached to be able to measure the ambient temperature, or estimate the head temperature based on that measured temperature.

The carriage HC has a pin (not shown) engaging a spiral groove 5004 of a lead screw 5005 rotating via driving force transmission gears 5011, 5009, interlocked with the forward and backward rotation of a driving motor 5013, and is reciprocated in the direction as indicated by the arrow a or b along with the rotation of the lead screw 5005. 5002 is a paper presser plate for pressing the recording medium P against the platen 5000 over the carriage movement direction. 5007 or 5008 is a photo-coupler which serves as home position detecting means to switch the rotational direction of the motor 5013 by making sure the existence of a lever 5006 of the carriage HC in this area. 5016 is a member for supporting a cap member 5022 for capping the discharge orifice face of recording head. 5015 is a suction pump for sucking the inside of the cap to perform suction recovery of the recording head 5012 via an opening within the cap.

5017 is a cleaning blade, and 5019 is a member for allowing this blade 5017 to move in the forward and backward directions, both of them being supported by a support plate 5018 on the main unit. 5012 is a lever for starting the suction recovery, which is moved along with the movement of a cam 5020 engageable with the carriage HC, the driving force from the driving motor being transferred under control by well-known means such as a clutch switch. Those capping, blade cleaning and suction recovery are configured such that when the carriage HC moves to the home position side area, their desired processings can be carried out at corresponding positions by the action of the lead screw 5005.

Figure 3:
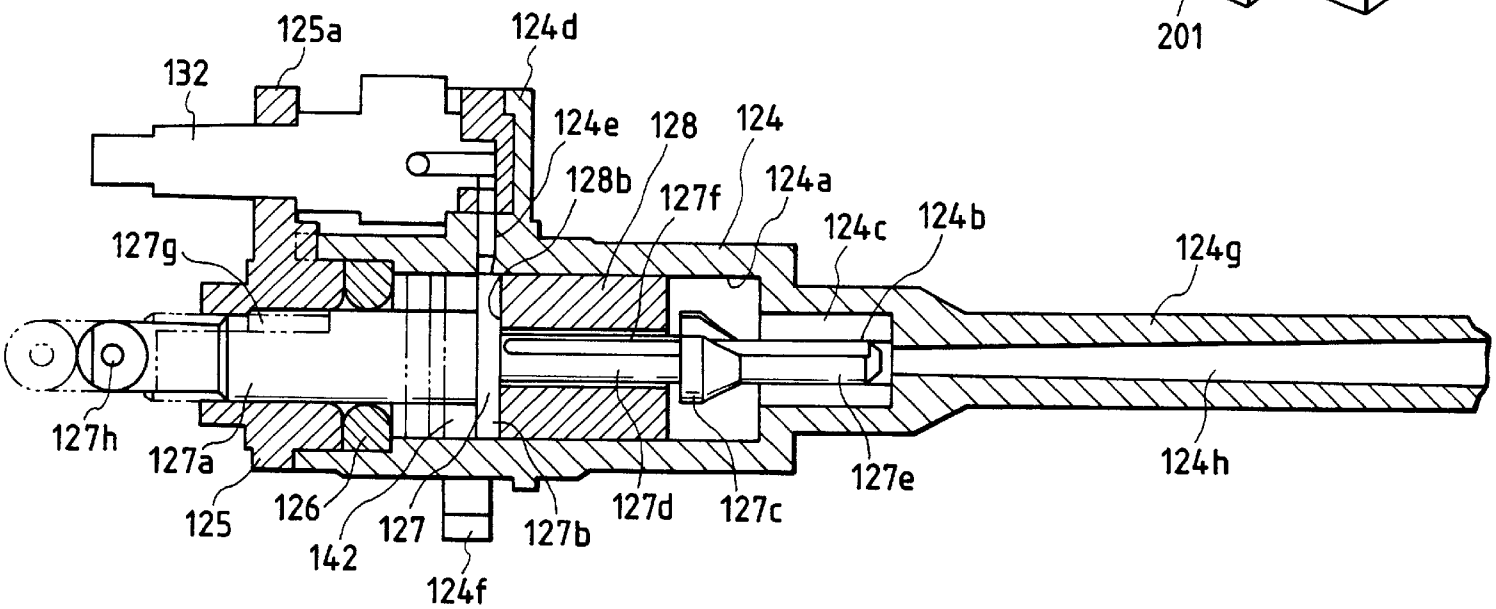
FIG. 3 is a cross-sectional view showing a cylinder pump for use with the example of the present invention.

FIG. 3 is a cross-sectional view showing a cylinder pump for use with the example of the present invention.

In FIG. 3, 124 is a cylinder having a cylinder portion of cylindrical shape and a guide portion 124*b* for guiding a piston shaft as will be described later, the guide portion 124*b* being formed with an ink flow passage 124*c* by cutting away a part thereof in the axial direction. 124*d* is a cap lever carriage which is formed for a lever seal as described below to be fitted therein. Also, 124*e* is an ink flow passageway which is open at a predetermined position within the cylinder portion 124*a*. 124*f* is a rotation lever which is formed integrally with the cylinder, to which a rotational force is applied by appropriate means. 124*g* is a waste ink tube which is formed integrally with the cylinder 124, and made to be easily inserted into a waste ink absorbing member as will be described later by cutting its top end portion at acute angle. 124*b* is an ink flow passageway formed within the waste ink tube 124*g*. 125 is a cylinder cap which is pressed into the end portion of the cylinder 124. 125*a* is a lever guide which is disposed at a position opposite the cap lever carrier 124*d* of the cylinder 124. 126 is a piston seal to be fitted into the cylinder 124, its inner diameter being made slightly smaller to obtain a predetermined pressing contact force with a piston shaft. Also, a lubricant may be applied on the surface to reduce the sliding force of the piston shaft. 127 is the piston shaft formed of an operation shaft 127*a*, a piston presser 127*b*, a piston receiver 127*c*, a connecting shaft 127*d* and a guide shaft 127*e*, further a groove 127*f* which becomes an ink flow passageway being formed along the connecting shaft 127*d* and the guide shaft 127*e*. 127*g* is a rotation stop which is formed as a groove in the operation shaft 127*a*. Also, on the end surface of the operation shaft 127*a* is provided a bearing portion 127*h*. 128 is a piston, of which the main body constituting an inner layer as seen from the side of the cylinder sliding portion is formed of an elastic member. Its outer diameter is formed larger by a predetermined amount than the inner diameter of the cylinder 124, whereby the piston is compressed adequately when inserted into the cylinder 124. 132 is a cap lever for supporting the cap member 5022 (see FIG. 1), which lever is a member for bringing the cap member 5022 into or out of contact with the discharge orifice face of the head, and has internally an ink suction channel.

FIGS. 4A to 4D are process views in cross section for explaining a suction recovery process which is performed using a cylinder pump according to the example of the present invention.

To start, the cap member 5022 (see FIG. 1) is pressed against the discharge orifice face by an appropriate mechanism. After the capping is terminated with the discharge orifices enclosed, the suction recovery operation is entered.

Figure 4A:
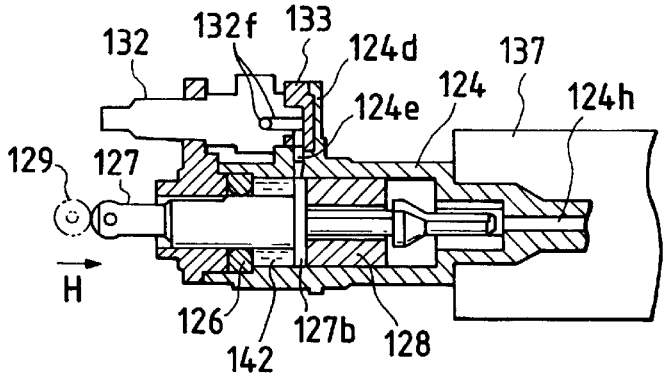
FIGS. 4A to 4D are process views in cross section for explaining a suction recovery process which is performed using the cylinder pump according to this example of the present invention.
Figure 4B:
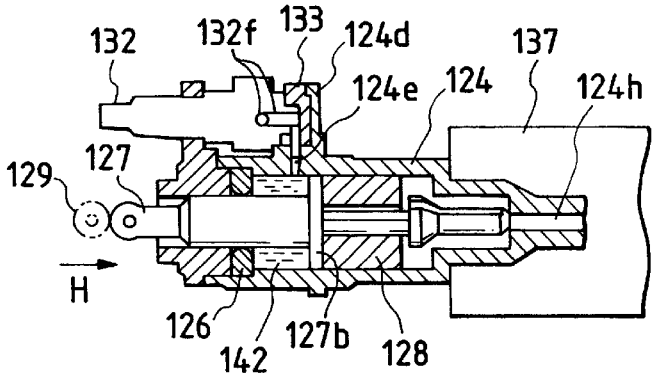

First, if a member not shown presses a piston pressing roller attached to the piston shaft 127, the piston shaft 127 is moved in a direction of H as shown in FIGS. 4A and 4B. The piston 128 is moved in the H direction, pressed by the piston presser 127*b*, so that a pump chamber 142 is placed in a negative pressure state. Since the ink flow passageway 124*e* of the cylinder 124 is blocked by the piston 128, the negative pressure of the pump chamber 142 only increases, while the piston is movable.

If the ink flow passageway 124*e* is opened, the ink of the head is sucked via the cap. The sucked ink passes through an ink flow passageway 132 formed within the cap lever 132, through a communication hole of the lever seal 133, through the ink flow passageway 124*e* of the cylinder 124, into the pump chamber 142, so that the negative pressure of the pump chamber is relieved.

Figure 4C:
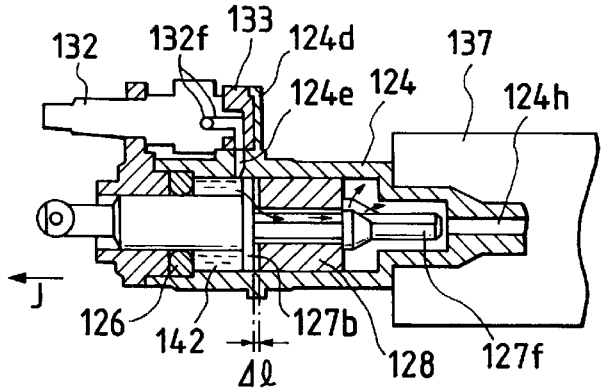
Figure 4D:
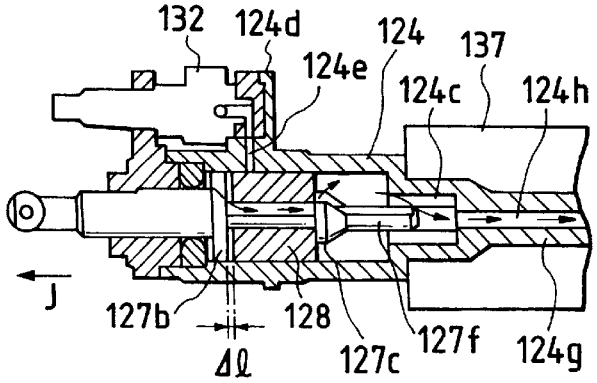

Next, if the piston shaft 127 is pulled in a direction of J by an appropriate mechanism, the piston shaft 127 is abutted against the piston receiver 127*c* and then moved in a direction of the arrow J, as shown in FIGS. 4C and 4D, so that there occurs a clearance Δ1 between the end surface 128*b* (see FIG. 3) of the piston 128 and the piston presser 127. However, by the movement of the piston shaft 127 and the piston 128, the waste ink sucked within the pump chamber 142 is discharged through the clearance A1, the groove 127*f* of the piston shaft, and the ink flow passageway 124*c* of the cylinder 124 into the waste ink absorbing member 137 almost centrally.

Figure 2:
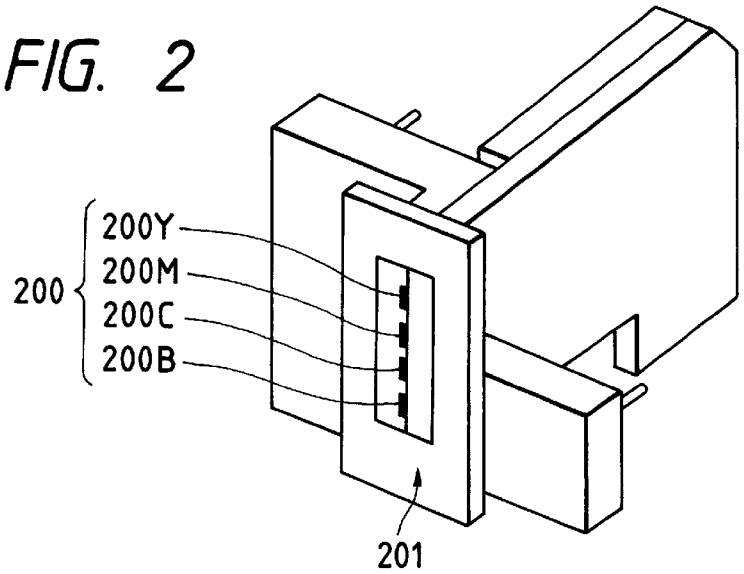
FIG. 2 is a perspective view showing an example of an ink jet recording head of multi-color integral type which is mounted on the ink jet recording apparatus according to an example of the invention.

FIG. 2 is a perspective view showing an example of an ink jet recording head of multi-color integral type which is mounted on an ink jet recording apparatus according to the example of the present invention.

The use of this head allows, unlike the case of making color recording using four separate recording heads, the color recording with a small-sized apparatus. To make full use of the merits of such recording head of multi-color integral type, that is, the accomplishment of reduction in size, it is preferable to perform a recovery operation similar to that for the monochrome head, also when making the recovery operation peculiar to the ink jet recording method such as suction. That is, it is desirable to be able to effect recovery by sucking the ink collectively from all the nozzles by one suction, but not separately sucking the ink from the nozzles for each color over multiple times. However, if the ink is sucked collectively from all the nozzles for the recording head of multi-color integral type, an irregular flow of the ink may occur within the cap, sometimes resulting in a problem that the ink sucked from the nozzles by suction may enter other nozzles of different color. This will appear on the image as discoloration (hereinafter referred to as color mixing) of a writing start portion for each color after the recovery.

To prevent this color mixing, it is necessary to discharge the quantity of mixed color ink out of the nozzles by the predischarge before printing, but the ink used in this predischarge is not usable for the printing, or waste ink in a sense, and desirably reduced to the minimum. Accordingly, it is desirable to suppress this color mixing to the lowest level.

In FIG. 2, there are 24 nozzles for yellow, magenta, and cyan inks (denoted by 200Y, 200M, 200C), respectively, and 64 nozzles for black ink (200B), with the interval between each color nozzle corresponding to 8 nozzles, and the nozzle pitch (resolution) of 360 dpi, wherein these nozzles are arranged in one line on the discharge orifice face 201. This ink jet recording head can discharge the ink in such a manner as to produce bubbles in the ink by heating the ink using the heat energy generated by electrothermal converters (heaters) provided along the ink passageways communicating to the discharge orifices. Herein, it is possible to discharge ink droplets having a volume of about 40 pl for the color inks, and about 80 pl for the black ink at about 6 kHz.

For the black ink, after the components as listed in Table 1 are mixed and fully agitated, they are filtered under pressure though a Floropore filter (manufactured by Sumitomo Electric) having a pore size of 0.45 μm to obtain the black ink. This ink is a waterproof ink containing urea which becomes water insoluble after drying. For the color inks, the normal non-waterproof inks for BJC-600 printer (manufactured by Canon Inc.) were used.

TABLE 1

| Ink composition (Components) | Mixture ratio (Weight ratio) |
|---|---|
| 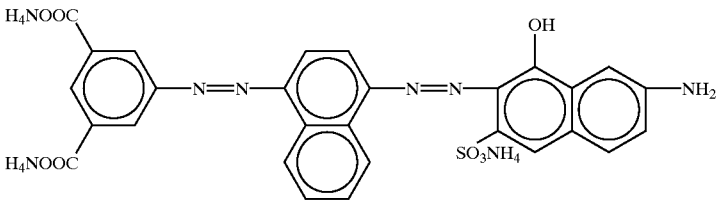 | 2.7% |
| C.I. direct yellow 86 | 0.3% |
| Ethylene gloycol | 10% |
| Urea | 7% |
| Ammonium sulfate | 0.6 % |
| Sodium hydroxide | 0.6 % |
| Ethanol | 5% |
| Water | 73.8% |

Figure 5:
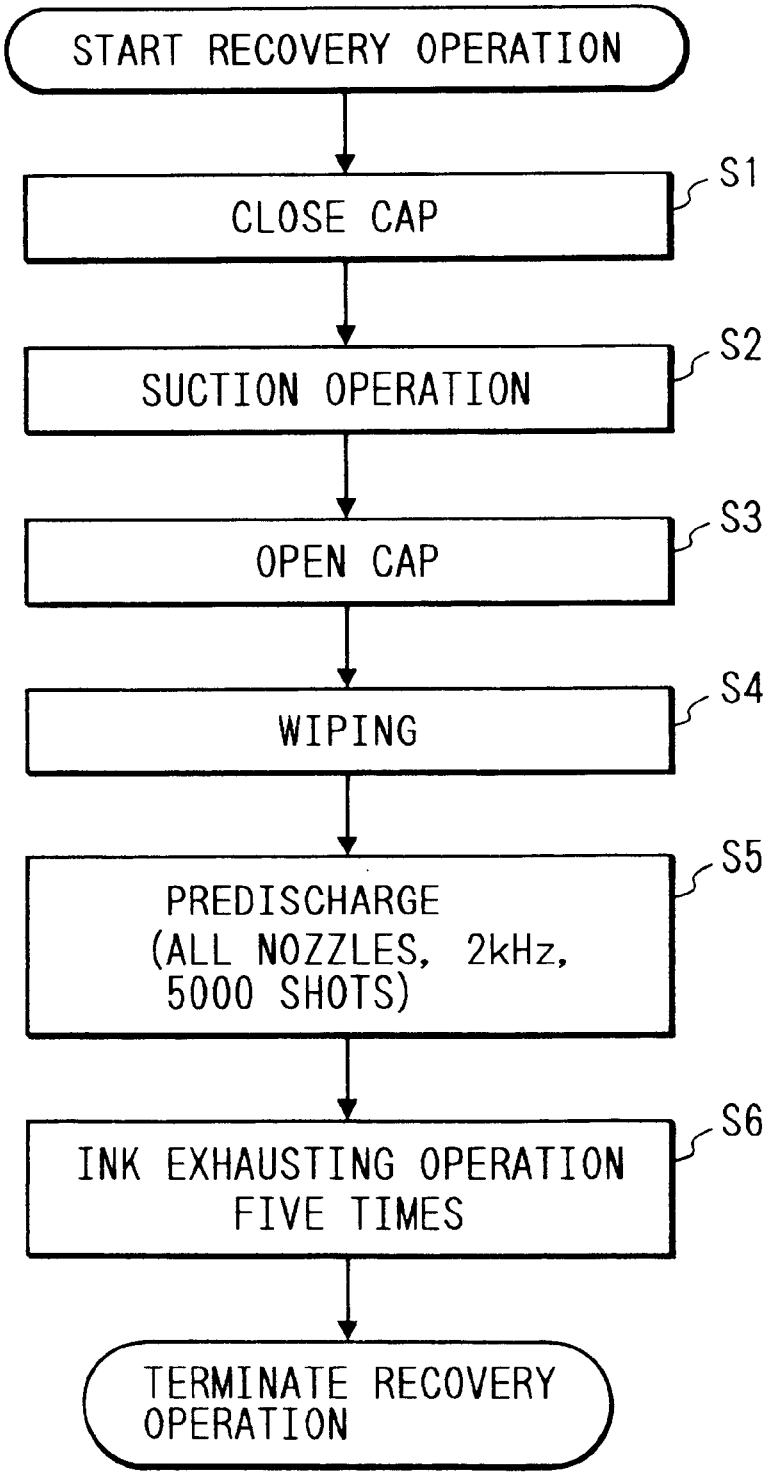
FIG. 5 is a flowchart for explaining an example 1 of the invention.

FIG. 5 is a flowchart for explaining an example 1 of the present invention.

In this example, with the ink jet recording apparatus as previously described, a suction recovery sequence, as shown in the flowchart of FIG. 5, includes the capping state (S1), suction (S2), immediately opening the cap (S3), wiping (S4), predischarging of 5000 shots at 2 kHz from all the nozzles of all colors (S5), and idle suction operation (ink evacuating operation from within the suction mechanism) five times (S6).

Thereafter, the test of printing on the recording sheet was repeated 200 times, but there occurred no discoloration (color mixing) on the writing start portion even once. Then, the apparatus was stored for one month under the environment of 60° C., and the same test was conducted again, in which case no abnormality was seen in the operation of the apparatus, with no color mixing.

Figure 6:
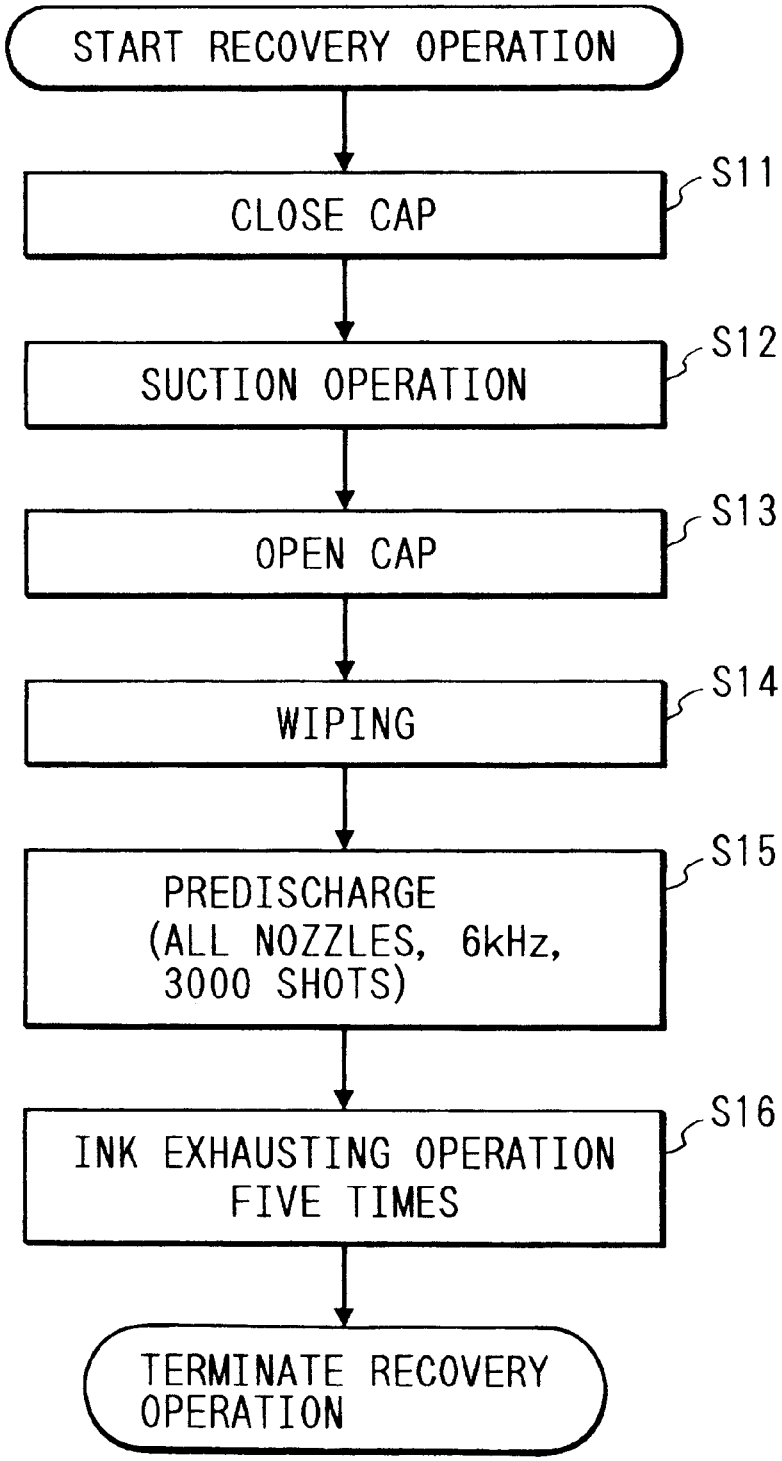
FIG. 6 is a flowchart for explaining an example 2 of the invention.

FIG. 6 is a flowchart for explaining an example 2 of the present invention.

In this example 2, the ink jet recording apparatus as used in the example 1 was employed. A suction recovery sequence, as shown in FIG. 6, includes the capping state (S11), suction (S12), immediately opening the cap (S13), wiping (S14), predischarging of 3000 shots at 6 kHz from all the nozzles of all colors (S15), and idle suction operation five times (S16). That is, the recovery sequence was conducted at a higher frequency of predischarge and with less shots for predischarge than in the example 1.

After termination of the recovery sequence, the test of printing on the recording sheet was repeated 2000 times, but there occurred no discoloration (color mixing) on the writing start portion even once. Then, the apparatus was stored for one month under the environment of 60° C., and the same test was conducted again, in which case no abnormality was seen in the operation of the apparatus, with no color mixing.

Figure 7:
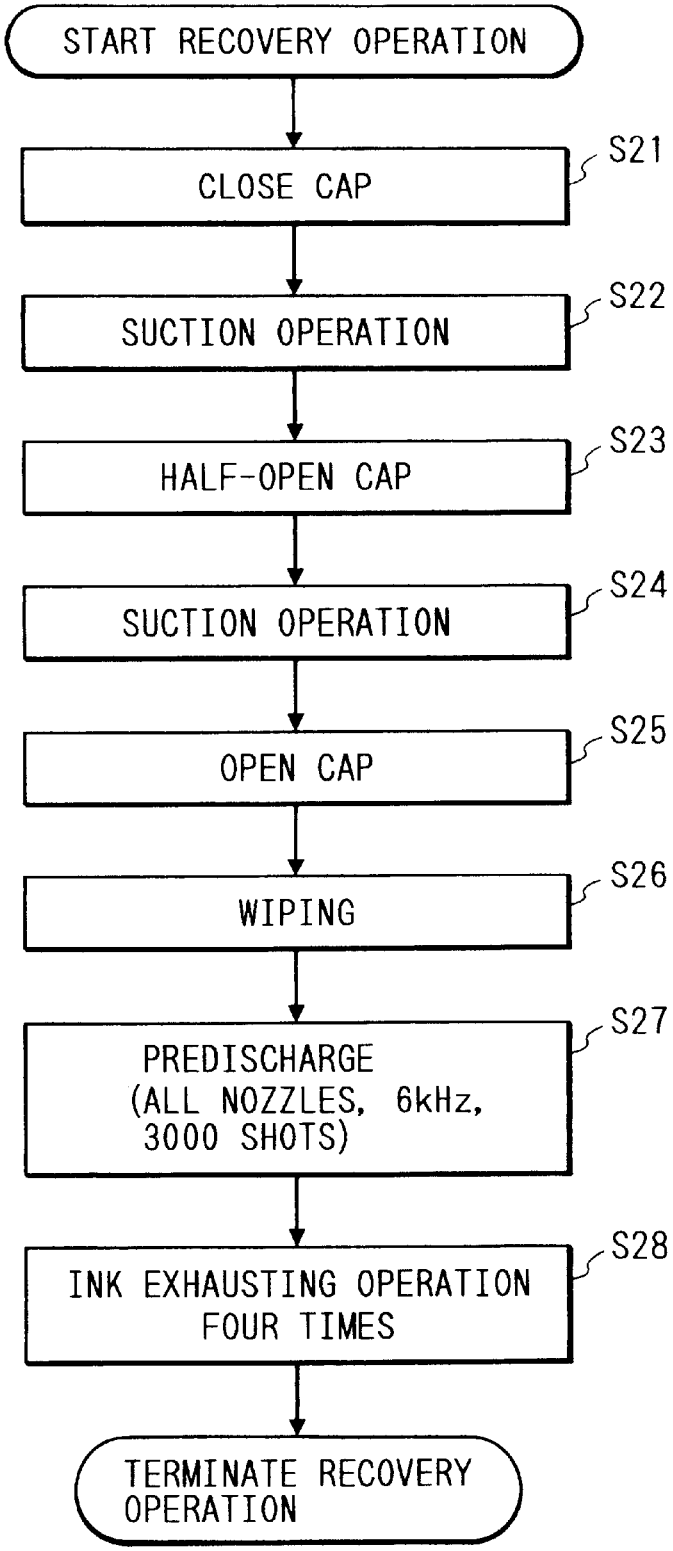
FIG. 7 is a flowchart for explaining an example 3 of the invention.

FIG. 7 is a flowchart for explaining an example 3 of the present invention.

In this example 3, the ink jet recording apparatus as used in the example 3 was employed. A suction recovery sequence, as shown in FIG. 7, includes the capping state (S21), suction (S22), the cap half-opened state (S23: a discharge orifice face contact portion of the cap only partly covering the discharge orifice face of head), suction operation (S24) to suck the ink remaining on the discharge orifice face of head, then opening the cap (S25), wiping (S26), predischarging of 3000 shots at 6 kHz from all the nozzles (S27), and idle suction opening four times (S28).

After termination of the suction sequence, the test of printing on the recording sheet was repeated 200 times, but there occurred no discoloration (color mixing) on the writing start portion even once. Then, the apparatus was stored for one month under the environment of 60° C., and the same test was conducted again, in which case no abnormality was seen in the operation of the apparatus, with no color mixing.

It should be noted which of the examples 2 and 3 can reduce the color mixing or the amount of predischarging may depend on the conditions including the water repellent property of the discharge orifice face of head, and the properties of the ink (surface tension, contact angle), and finally must be determined by the experiments including a durability test, but when the ink remains quite a lot on the discharge orifice face of head, the example 3 is more preferable.

Figure 8:
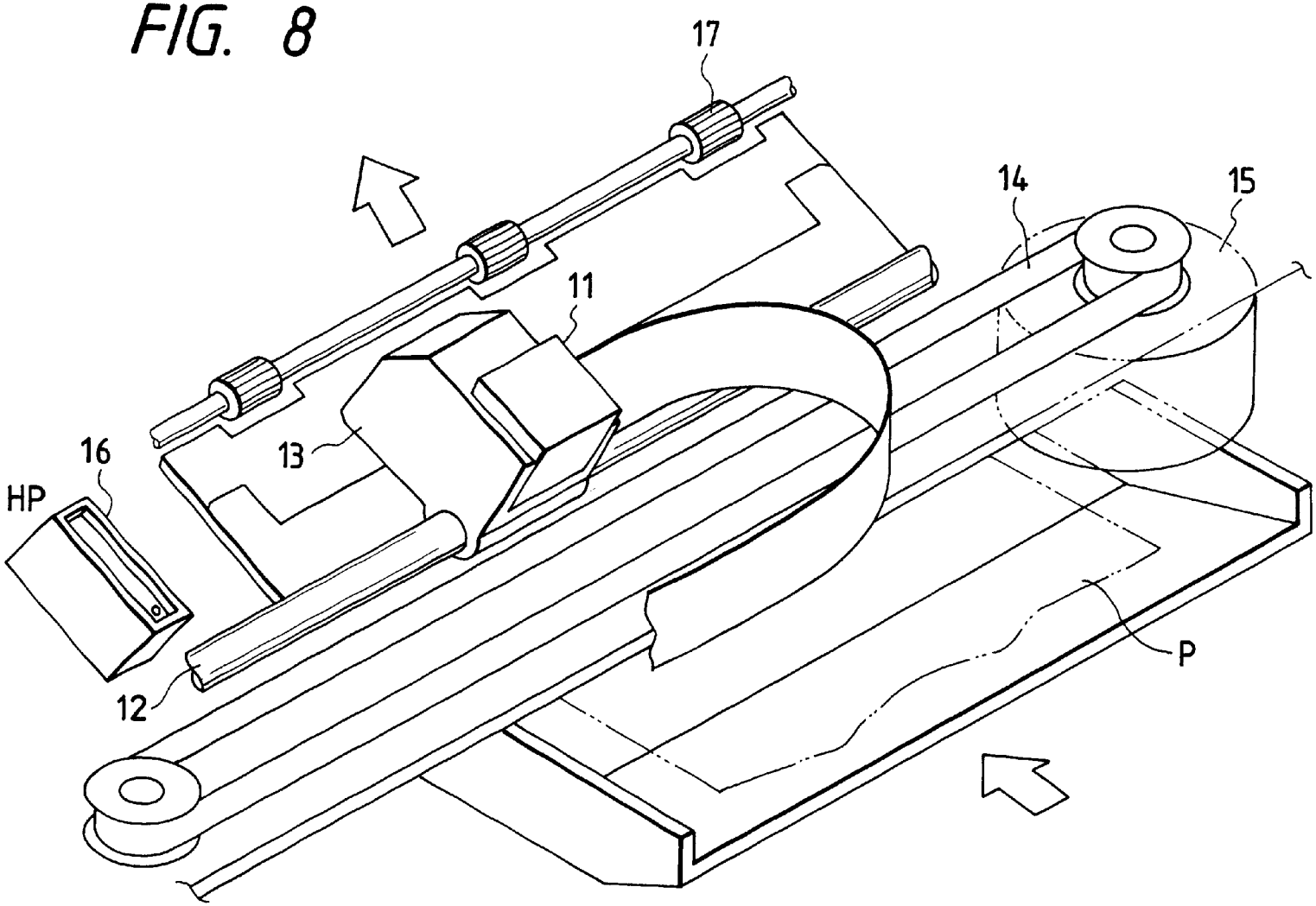
FIG. 8 is a perspective view showing the essence of another ink jet recording apparatus according to an example of the present invention.

FIG. 8 is a perspective view showing the essence of another ink jet recording apparatus according to another example of the present invention.

An ink jet head 11 (also referred to as an ink jet unit) having discharge orifices for discharging the ink arranged in series is disposed on a carriage 13. The recording medium P composed of the paper or plastic thin sheet is carried by paper exhausting rollers 17 via a conveying roller (not shown), and fed in a direction of the arrow by the driving of a conveying motor, not shown. By a guide shaft 12 and an encoder (not shown), the carriage 13 is guided and supported. The carriage 13 is reciprocated along the guide shaft 12 by the driving of a carriage motor 15 via a driving belt 14.

In the ink flow passageways communicating to the ink discharge orifices of the ink jet unit, the electrothermal energy converters which are heat generating elements for generating the heat energy for use in discharging the ink are provided. The heat generating elements are driven based on the recording signal in accordance with the reading timing of an encoder (not shown) to fly and attach the ink as liquid droplets onto the recording sheet P, thereby forming an image.

At a home position (HP) of the carriage chosen outside the recording area, a recovery unit having a cap portion 16 is disposed. When the recording is not conducted, the carriage 13 is moved to the home position (HP) to enclose the ink discharge orifice face of the ink jet unit with the cap portion 16, preventing the ink fixing caused by evaporation of ink solvents, or the clogging due to sticking of foreign matter such as dust or paper powder. The cap portion 16 is used in a predischarge mode of discharging the ink into the cap portion 16 spaced apart from the ink discharge orifices to resolve the discharge failure or clogging due to ink thickening or fixing in the ink discharge orifices having less recording frequency, or employed for the recovery of the discharge function of ink discharge orifices which have caused discharge failure by operating a pump not shown in the capped state and sucking the ink through the ink discharge orifices. Also, by disposing a blade at a position adjacent the cap portion, it is possible to clean the ink discharge face of the ink jet unit.

Figure 9:
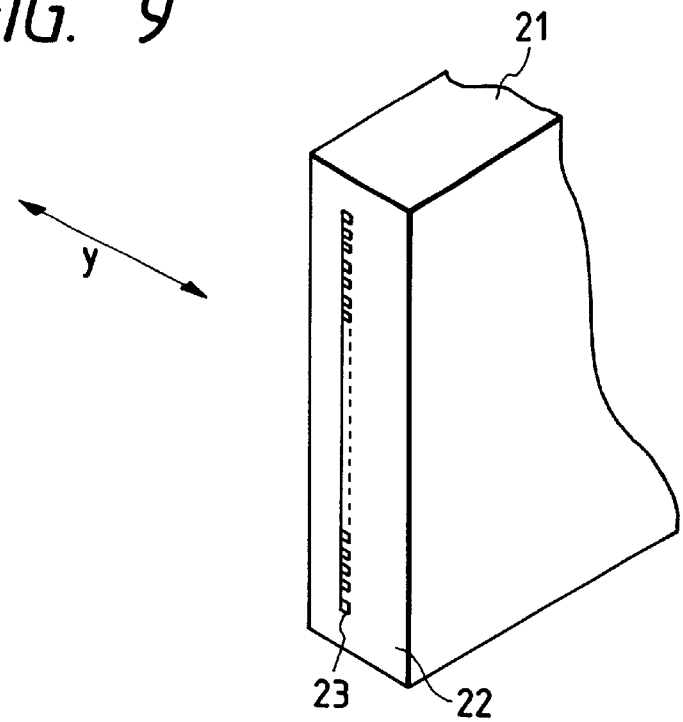
FIG. 9 is a typical perspective view showing an array of ink discharge orifices of the ink jet recording head as seen from the recording medium side.
Figure 10:
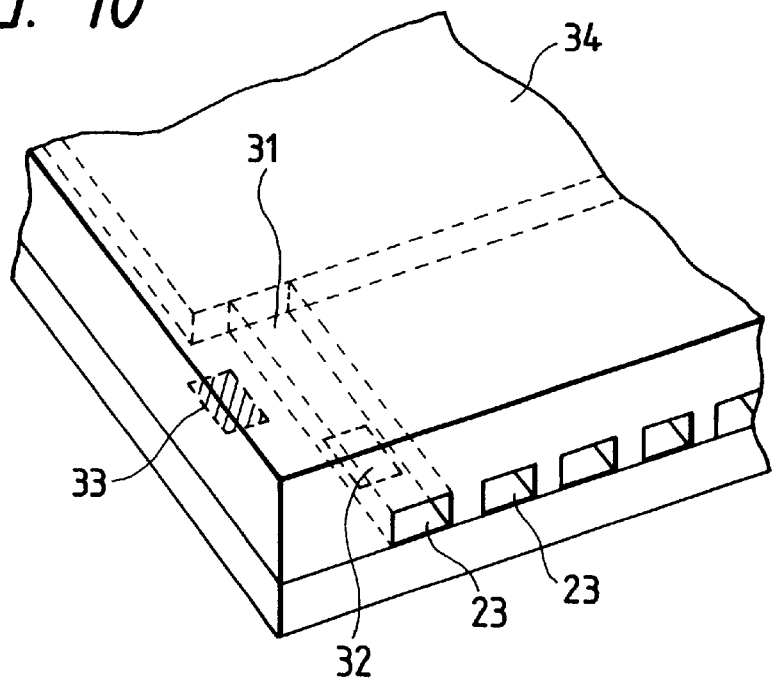
FIG. 10 is a typical partial perspective view showing the structure of an ink discharge portion of the ink jet recording head.

FIG. 9 is a typical perspective view showing an array of ink discharge orifices for an ink jet recording head as seen from the side of the recording sheet. FIG. 10 is a typical partial perspective view showing the structure of an ink discharge portion of the ink jet recording head.

This recording head has a discharge orifice face 22 having a plurality of open discharge orifices 23 arranged, with the energy generating elements 32 for generating the energy for use in discharging the ink being each disposed in a liquid channel portion 31 in communication with a discharge orifice 23 thereof. The arrow y indicates the scan direction of the carriage 13. In FIG. 10, 33 is a sensor for sensing the temperature of recording head, and in this example, a thermistor 33 is provided on either end of the array of discharge orifices. Temperature sensing means may include, in addition to this, another sensors such as a diode sensor or the head temperature may be calculated from the duty of print dot. 34 is a common ink chamber.

Figure 11:
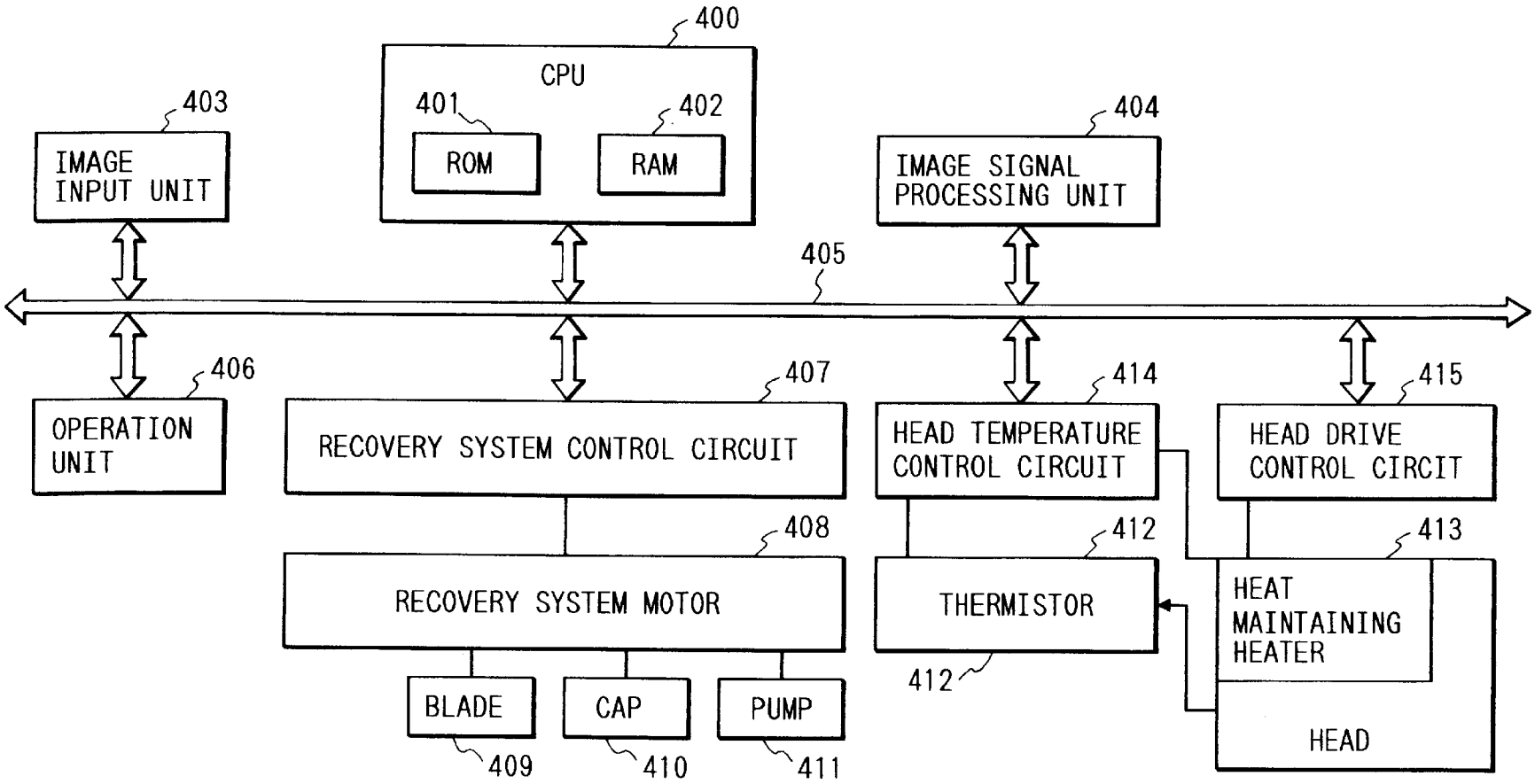
FIG. 11 is a block diagram of an ink jet recording apparatus according to the example of the present invention.

FIG. 11 is a block diagram of an ink jet recording apparatus according to the example of the present invention. As shown in FIG. 11, the configuration of this recording apparatus can be largely divided into software system processing means including an image input unit 403, an image signal processing unit 404 correspondingly provided, and a central processing unit CPU 400 which have access to a main bus line 405, and hardware system processing means including an operation unit 406, a recovery system control circuit 407, an ink jet head temperature control circuit 414, and a head driving control circuit 415. The CPU 400 has normally a read only memory (ROM) 401 and a random access memory (RAM) 402, for effecting the recording by driving the recording head 413 under proper recording conditions given for the input information.

Within the RAM 402 is stored a program for executing a discharge function recovery timing chart to carry out the discharge recovery by moving the carriage to the home position (HP), the recovery conditions such as predischarge conditions being given to the recovery system control circuit 407, the recording head 413 and the temperature retaining heater, as required. A recovery system motor 408 drives the recording head, a cleaning blade 409 or a cap 410 which is oppositely placed with a spacing, and a suction pump 411. The head driving control circuit 415 is to control the driving conditions of the electrothermal converters for the ink discharge from the recording head to cause the recording head to perform the predischarge or the discharge of recording ink.

The recording head 413 has the temperature retaining heater provided on a substrate where the electrothermal converters for the ink discharge are disposed, with which the ink temperature within the recording head can be regulated by heating to a set temperature as desired. Also, a thermistor 412 is also provided on the substrate to measure the ink temperature within the recording head. Note that the thermistor 412 and the temperature retaining heater may be provided outside the substrate, but not on the substrate, or around the recording head.

Figure 12:
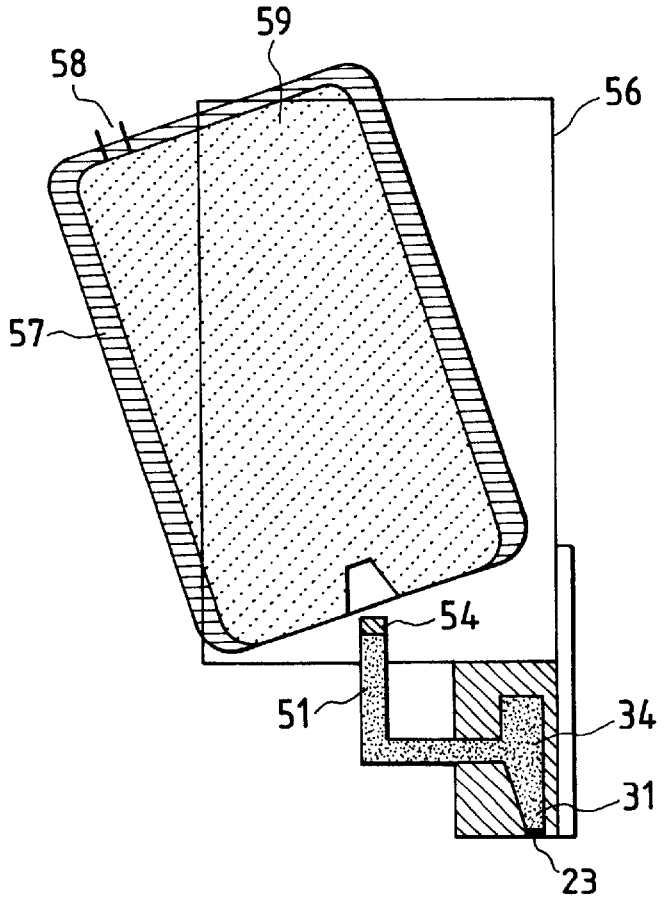
FIG. 12 is a typical cross-sectional view showing an ink jet pen having a replaceable ink tank according to the example of the invention.

FIG. 12 is a typical cross-sectional view showing an ink jet pen having a replaceable ink tank according to the example of the present invention.

This ink jet pen has an atmosphere communicating opening 58 through which the ink and the atmosphere can be exchanged, an ink tank 57 containing an absorbing member 59 holding the ink being replaceable with the head along a tank guide 56. The ink within the ink tank 57 passes through a filter 54 trapping the dirt in the ink via an ink supply passageway 51 to a common ink chamber 34 to the ink passageways 31 having heaters disposed to the discharge orifices 23.

Since the ink tank 57 is replaceable, the ink will vaporize from a portion of the filter 54 or some of ink discharge orifices 23 if the ink tank is not attached to the head, possibly resulting in a phenomenon that the ink solidifies and is fixed in the ink passageways. In particular, because the ink used in the example as described below is the waterproof ink which becomes water insoluble after drying, the technical problem of ink fixing is remarkable.

Figure 13:
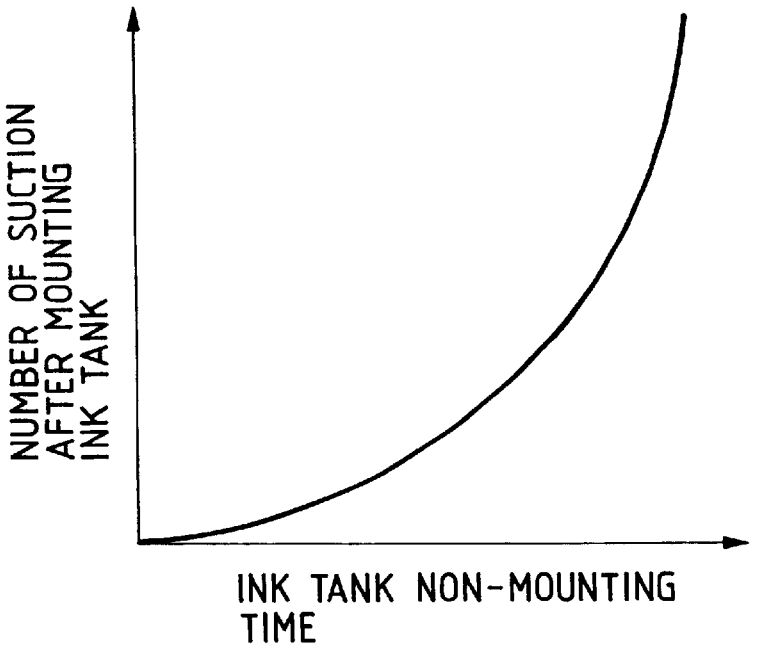
FIG. 13 is a graphical representation showing the qualitative relationship between the time for which the ink tank is not attached to the head, and the number of suction operations required to recover the function until the ink is discharged from all the ink discharge orifices after attaching the ink tank.

FIG. 13 is a graph showing the qualitative relationship between the time for which the ink tank is not attached to the head, and the number of suction operations required to recover the function to allow the ink to be discharged from all the ink discharge orifices after attaching the ink tank. As can be seen from FIG. 13, there is a tendency that the longer the time for which the ink tank is not attached, the greater number of suctions is required until the ink can be discharged from all the ink discharge orifices.

Figure 14:
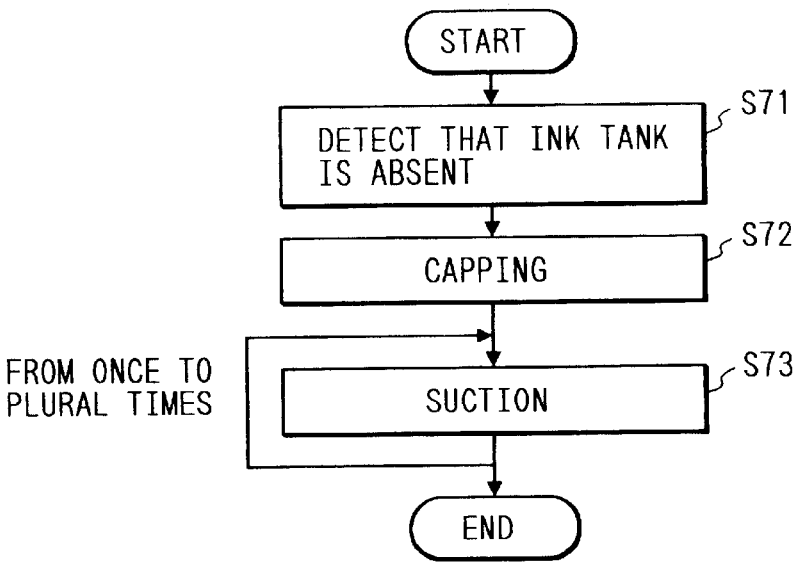
FIG. 14 is a flowchart showing the operation when the ink tank according to an example 4 of the invention is not attached.

FIG. 14 is a flowchart showing the operation where the ink tank according to an example 4 of the present invention is not attached.

The replacing operation of ink tank is STARTed, and if the routine detects that the ink tank is absent (S71) in the ink tank existence detection, the routine effects the capping of the ink discharge orifice face of the recording head with the cap (S72), and the suction (S73) from once to plural times, and is ENDed in the print waiting state.

Figure 15:
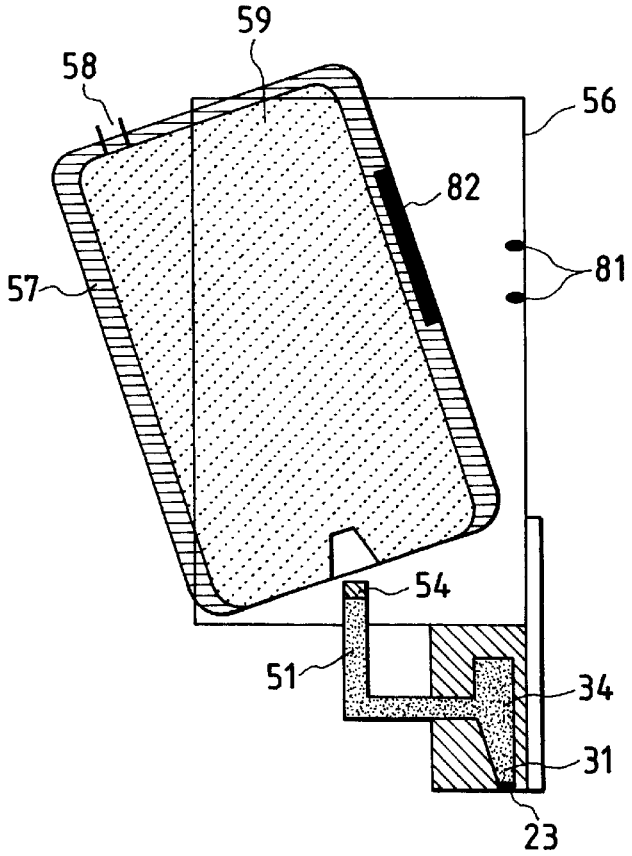
FIG. 15 is a typical cross-sectional view showing an ink jet pen having detecting means for detecting whether or not the ink tank is attached.

FIG. 15 is a typical cross-sectional view showing an ink jet pen provided with detecting means for detecting whether or not the ink tank is attached.

The ink jet pen, as shown in FIG. 15, has a detecting switch mechanism comprised of two electrodes 81 in the tank guide 56 and a conductive plate 82 in the ink tank 57. In FIG. 15, when the ink tank 57 is attached, the conductive plate 82 attached to the ink tank 57 and two electrodes 81 attached to the tank guide 56 are contacted, and conduct through the conductive plate 82, whereby this conductive state is detected as the tank being present. When the ink tank is not attached, the conductive plate 82 and two electrodes 81 do not conduct because they are not in contact, whereby this non-conductive state is detected as the ink being absent.

Upon the suction (S73) in FIG. 14, the suction force is made lower with a maximum negative pressure below 0.5 atm and at slow flow rate, so that the ink in the liquid channels 31, the common liquid chamber 34 and the supply passageway 51 within the recording head can be sucked without interruption and emptied.

Also, by making the suction (S73) operation of FIG. 14 only once, the ink in the liquid channels 31, the common liquid chamber 34 and the supply passageway 51 can be emptied, but more securely emptied by performing the same operation multiple times.

As above described, in the example 4, by performing the operation as shown in FIG. 14, even when the ink tank 57 is not attached to the head for a long time, the ink in the liquid channels 31, the common liquid chamber 34 and the supply passageway 51 within the recording head can be removed to thereby prevent ink fixing. Also, even if the fixing occurs, the supply passageway 51, the common liquid chamber 34 and all the liquid channels 31 are not clogged with the solidified ink, but necessarily partly communicate to ink discharge orifices. Therefore, if the suction operation is performed after attaching the ink tank, the fresh ink is conducted from the ink tank to the supply passageway 51 to the common liquid chamber 34 to the liquid channels 31, so that the portion which has caused fixing is more likely to redissolve, and can be recovered in short time, enabling the stable recording to be effected at all times.

Figure 16:
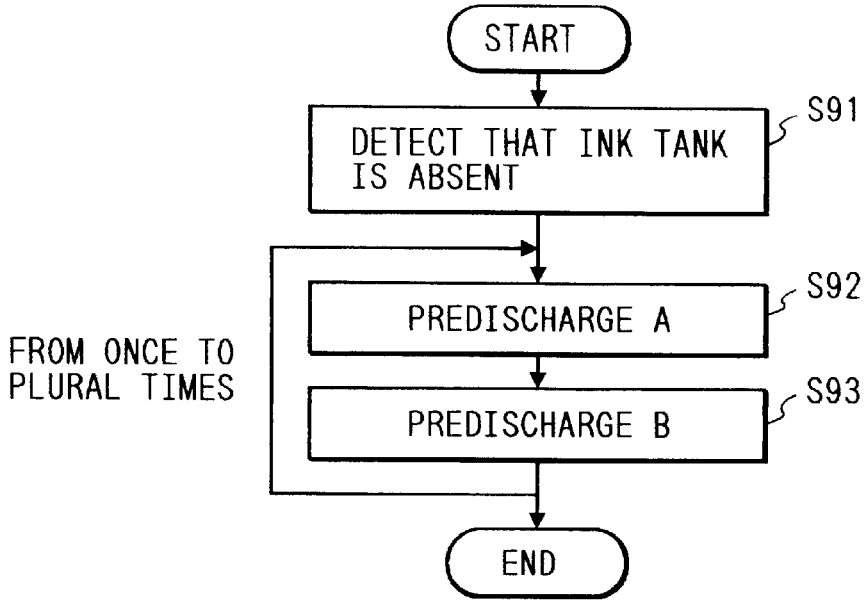
FIG. 16 is a flowchart showing the operation when the ink tank according to an example 5 of the invention is not attached.

FIG. 16 is a flowchart showing the operation where the ink tank is not attached according to an example 5 of the present invention.

The replacing operation of ink tank is STARTed, and if the routine detects that the ink tank is absent (S91) in the ink tank existence detection, the routine performs predischarge A (S92) and predischarge B (S93) at the home position from once to plural times, and is ENDed in the print waiting state.

At the predischarge step of FIG. 16, the setting of the conditions is made in accordance with the ink material and the shape of ink discharge orifices, but it has been found that if the driving frequency of head is made different between the central portion and the end portion of the array of ink discharge orifices, the higher effects can be obtained. The central portion is subject to predischarge A (S92) and the end portion is subject to predischarge B (S93), as shown in FIG. 16. Specifically, the driving frequency of head is as low as 3kHz or less in the central portion of the array of ink discharge orifices and higher in the end portion than in the central portion, i.e., preferably in a range from 3 to 8 kHz. Thereby, the ink in the liquid channels, the common liquid chamber and the supply passageway within the recording head can be discharged without interruption until being emptied. By performing the operation of predischarge A and that of predischarge B each once in FIG. 16, the ink in the liquid channels, the common liquid chamber and the supply passageway within the recording head can be emptied, but can be more securely emptied by performing the same operation multiple times.

As above described, in the example 5, by performing the operation as shown in FIG. 16, even when the ink tank is not attached for a long time to the head, the ink fixing phenomenon in the liquid channels, the common liquid chamber and the supply passageway within the recording head can be prevented. And since the fresh ink is conducted when the ink tank is attached, an inner portion having caused a fixing phenomenon, if any, can be redissolved in short time. Thereby, the recording head can be recovered in short time, and the stable recording can be always effected.

Figure 17:
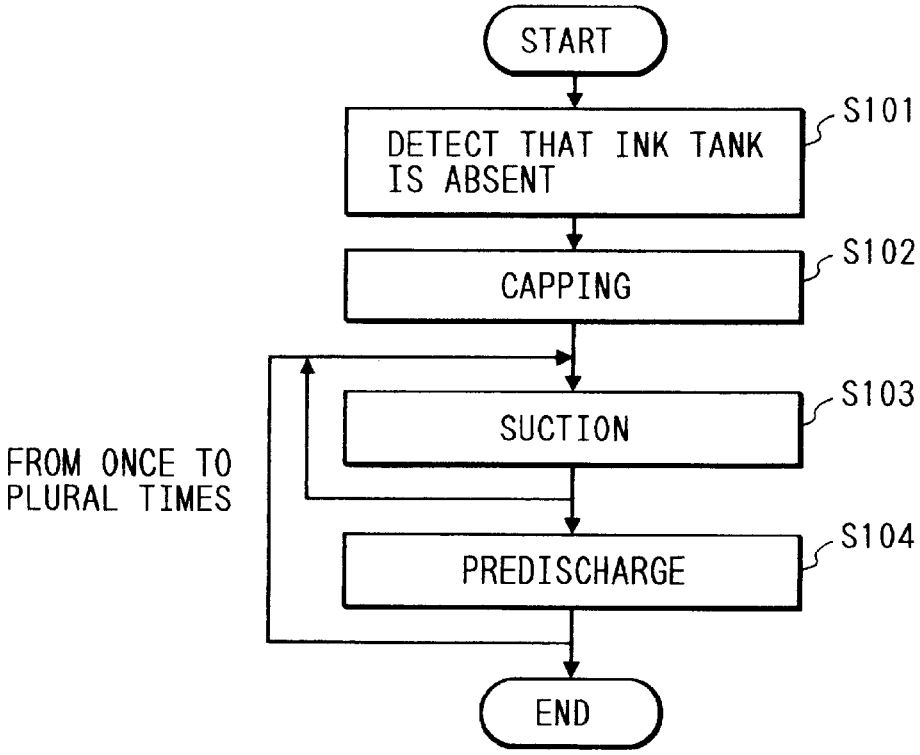
FIG. 17 is a flowchart showing the operation when the ink tank according to an example 6 of the invention is not attached.

FIG. 17 is a flowchart showing the operation where the ink tank is not attached according to an example 6 of the present invention.

The replacing operation of ink tank is STARTed, and if the routine detects that the ink tank is absent (S101) in the ink tank existence detection, the routine performs capping of the ink discharge orifice face of the recording head with the cap (S102), and two operations of suction (S103) and predischarge (S104) from once to plural times, and then is ENDed in the print waiting state. Means for detecting whether or not the ink tank exists may be a switch mechanism as shown in FIG. 15.

At the suction (S103) of FIG. 17, the suction is performed at slow flow rate from once to plural times by with a maximum negative suction pressure below 0.5 atm., and then, the predischarge, like the predischarge as shown in the example 5, is performed with a higher driving frequency of head in the end portion of the array of ink discharge orifices than in the central portion thereof, or with the same driving frequency of head, and the greater number of predischarges on both ends of the array of ink discharge orifices than in the central portion thereof, whereby the ink liable to remain on the wall surface of the common liquid chamber at its corner portion can be securely removed, and the ink in the liquid channels, the common liquid chamber and the supply passageway within the recording head can be securely emptied without interruption. Specifically, when the predischarge is performed with the driving frequency of head made higher in the end portion than in the central portion of the array of ink discharge orifices, the driving frequency is set to as low as 3 kHz or less in the central portion of the array of ink discharge orifices and is made higher in the end portion than in the central portion, i.e., preferably in a range from 3 to 8 kHz. When the number of predischarges is made greater in the end portion than in the central portion of the array of ink discharge orifices with the same driving frequency of head, it is preferable that the driving frequency of head is in a range from 0.5 to 8 kHz, and the predischarge is performed in a range from 1000 to 5000 dots in the central portion and from 5000 to 2000 dots in the end portion. By performing two operations of suction (S103) and predischarge (S104) of FIG. 17 only once, the ink in the liquid channels, the common liquid chamber and the supply passageway can be emptied, but by performing the same operation multiple times, the ink can be more securely emptied.

As above described, in the example 6, by performing the operation as shown in FIG. 17, even when the ink tank is not attached for a long time to the head, the ink fixing phenomenon which may arise in the liquid channels, the common liquid chamber and the supply passageway within the recording head can be prevented. And since the fresh ink is conducted when the ink tank is attached, an inner portion having caused fixing phenomenon, if any, can be redissolved in short time. Thereby, the recording head can be recovered in short time, and the stable recording can be always made.

Figure 18:
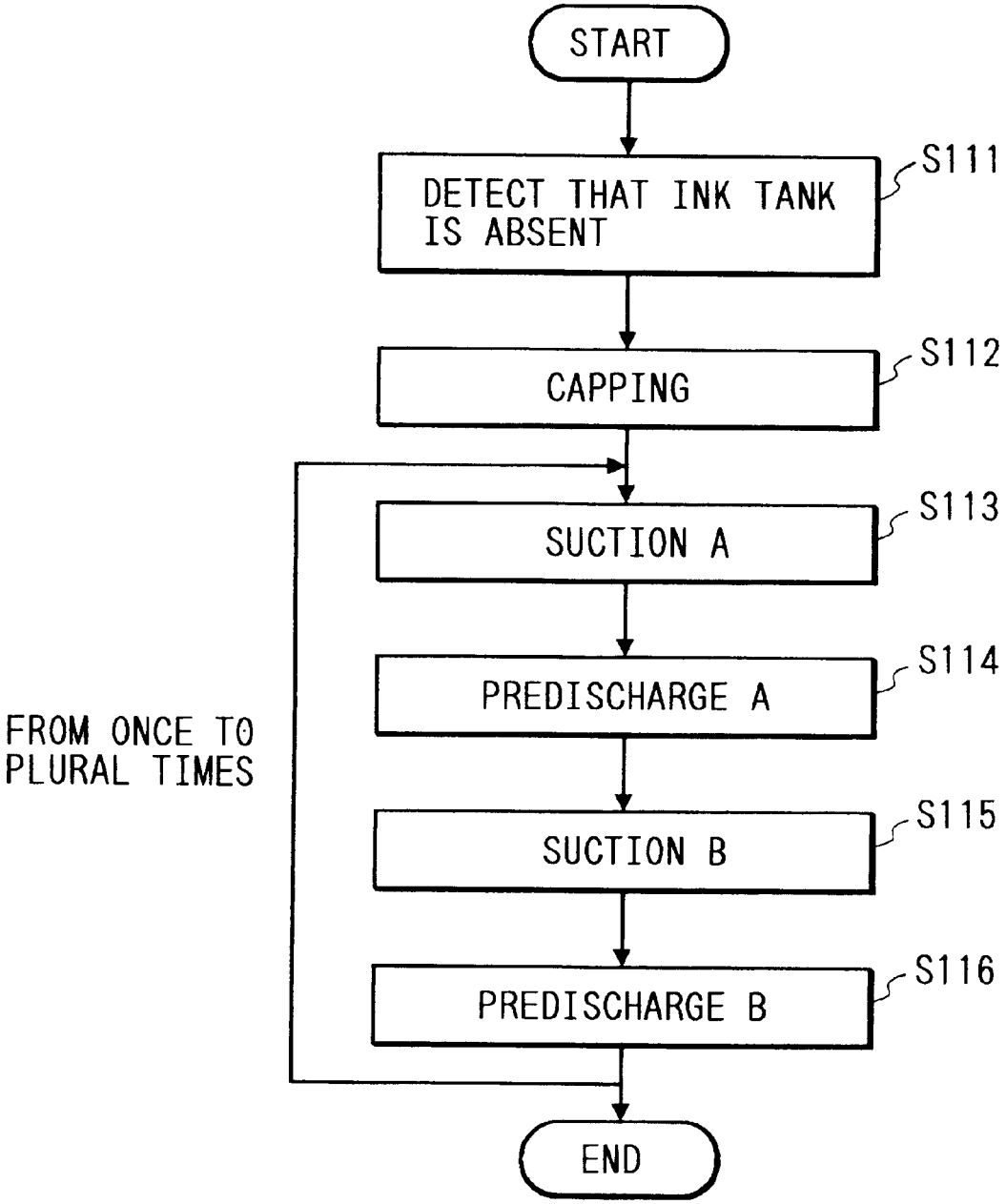
FIG. 18 is a flowchart showing the operation when the ink tank according to an example 7 of the invention is not attached.

FIG. 18 is a flowchart showing the operation where the ink tank is not attached according to an example 7 of the present invention.

The replacing operation of ink tank is started, and if the routine detects that the ink tank is absent (S111) in the ink tank existence detection, the routine performs capping of the ink discharge orifice face of the recording head with the cap (S112), the operation including suction A (S113) and predischarge A (S114), and then the operation including suction B (S115) and predischarge B (S116) alternately from once to plural times, and then is ENDed in the print waiting state. Means for detecting whether or not the ink tank exists may be a switch mechanism as shown in FIG. 15.

At the suction A (S113) of FIG. 18, the suction is performed at slow flow rate by a weak suction force with the maximum negative pressure below 0.5 atm., and then, the predischarge A (S114) is performed with a driving frequency of head of 3 kHz or less which is lower than that of the normal recording, so that the ink in the liquid channels, the common liquid chamber and the supply passageway within the recording head can be securely emptied without interruption. Thereafter, the suction B (S115) of FIG. 18 is performed with a suction force stronger than the suction force of suction A, i.e., at a negative pressure of 0.5 atm. or more, and subsequently, the predischarge B (S116) of FIG. 18 is performed at a higher frequency than the driving frequency of head for the predischarge A, i.e., in a range from 3 to 8 kHz, so that the ink remaining on the wall surface of the liquid channels, the common liquid chamber and the supply passageway within the recording head can be securely removed and emptied. By performing the operation of suction A (S113), predischarge A (S114), suction B (S115), and predischarge B (S116) only once, the ink in the liquid channels, the common liquid chamber and the supply passageway within the recording head can be securely emptied, but the ink can be more securely emptied by repeating the same operation plural times.

As above described, in the example 7, by performing the operation as shown in FIG. 18, even when the ink tank is not attached for a long time to the head, the ink fixing phenomenon arising in the liquid channels, the common liquid chamber and the supply passageway within the recording head can be prevented. And since the fresh ink is conducted when the ink tank is attached, a portion having caused fixing phenomenon, if any, can be redissolved in short time. Thereby, the recording head can be recovered in short time, and the stable recording can be always made.

Figure 19:
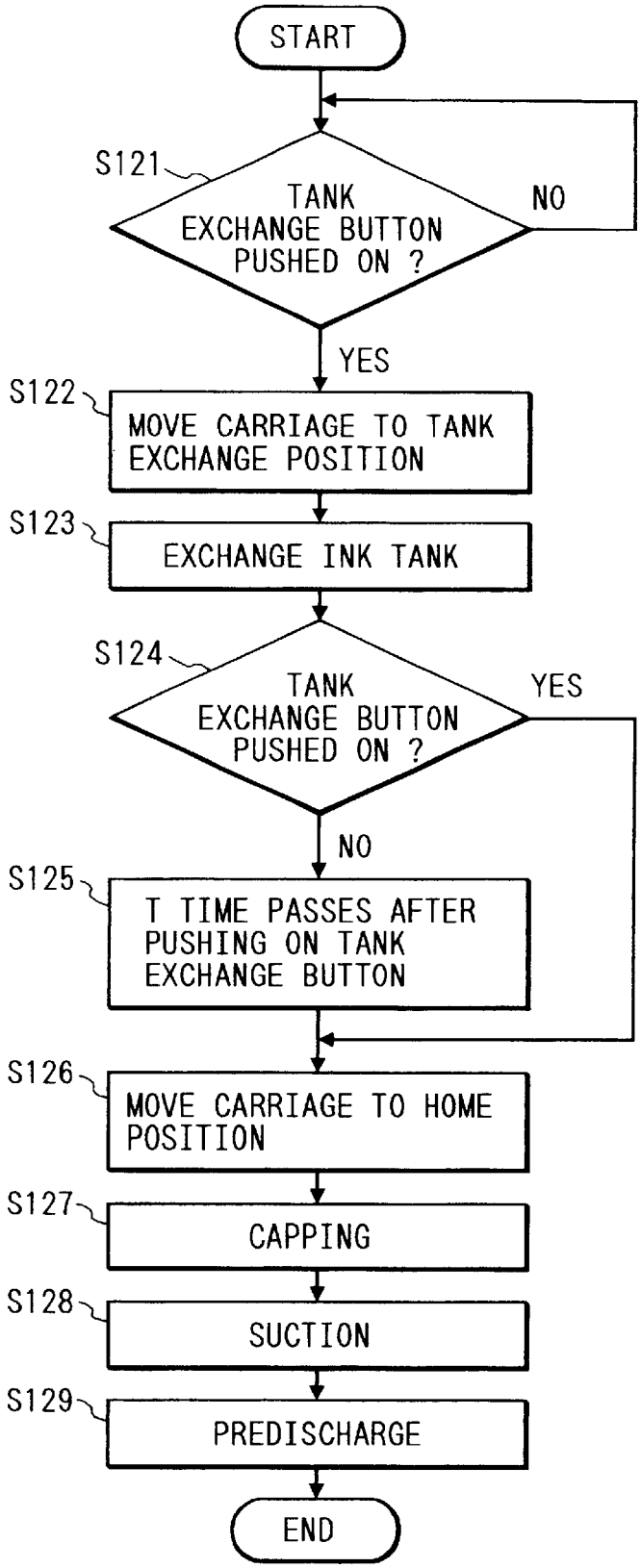
FIG. 19 is a flowchart showing the operation of the ink tank replacement when there is not provided means for detecting whether or not the ink tank exists according to an example 8 of the invention.

FIG. 19 is a flowchart showing the operation of ink tank replacement where there is not provided means for detecting whether or not the ink tank exists according to an example 8 of the present invention.

The apparatus is provided with a tank exchange button. A determination is made whether or not the tank exchange button is pushed on (S121), and if "Yes", the carriage having the ink jet recording head mounted thereon is moved from the home position to a tank exchange position in the central portion of a guide shaft (S122). The exchange work of ink tank is conducted (S123), and a determination is made whether or not the tank exchange button is pushed on again (S124). If "Yes" is determined, or if "No" is determined and T time has elapsed since the first tank exchange button ON (S125), the carriage is moved to the home position (S126). Since the fixing speed of ink may differ depending on the ambient temperature where the exchange work of ink tank is being conducted, T time at S125 can be varied in accordance with the ambient temperature.

If the carriage is moved to the home position (S126), without the ink tank attached, the recovery operation including suction and predischarge, like the examples 6 and 7, is performed at steps S127, S128 and S129, whereby the fixing phenomenon of ink in the liquid channels, the common liquid chamber and the supply passageway within the recording head can be prevented. On the other hand, if there is an ink tank attached, the fact that the ink tank is attached can be judged by detecting the difference in temperature elevation, depending on whether or not the ink exists, by a thermistor which can measure the ink temperature inside the recording head, when performing predischarge (S129) after the suction operation (S128). At such a time, the suction and predischarge may be canceled or suppressed to save the waste of ink.

As above described, in the example 8, by performing the operation as shown in FIG. 19, even when the ink tank is not attached for a long time to the head, without having means for detecting whether or not the ink tank exists, the ink fixing phenomenon which may arise in the liquid channels, the common liquid chamber and the supply passageway within the recording head can be prevented. On the other hand, when the ink tank is attached to the head, the waste of ink with the recovery operation can be eliminated, and the stable recording can be always effected.

What is claimed is:

1. An operation method for an ink jet recording apparatus, wherein the apparatus includes discharge orifices having waterproof ink orifices for discharging waterproof ink which becomes water insoluble after drying and non-waterproof ink orifices for discharging non-waterproof ink, a cap for covering said discharge orifices, and suction means for effecting suction through said discharge orifices when said cap covers said discharge orifices, said method comprising:

a covering step for covering both said waterproof ink orifices and said non-waterproof ink orifices collectively by said cap;

a suction step for effecting suction through both said waterproof ink orifices and said non-waterproof ink orifices by driving said suction means when said cap covers both said waterproof ink orifices and said non-waterproof ink orifices collectively;

a discharge step, performed after said suction step, for discharging ink from both said waterproof ink orifices and said non-waterproof ink orifices into said cap so that waterproof ink and non-waterproof ink are mixed in said cap;

an exhausting step, performed after said discharge step, for exhausting ink out of said cap by driving said suction means when an inside of said cap communicates with air.

2. An operation method for an ink jet apparatus according to claim 1, wherein said waterproof ink and said non-waterproof ink are different in color.

3. An operation method for an ink jet apparatus according to claim 1, wherein said waterproof ink contains urea.

4. An operation method for an ink jet apparatus according to claim 1, wherein said discharge step is performed when said cap opens said discharge orifices.

5. An operation method for an ink jet apparatus according to claim 1, further comprising a cleaning step for cleaning the face where said discharge orifices are provided by a wiper blade between said suction step and said discharge step, said discharge orifices being provided on a face of said apparatus.

6. An operation method for an ink jet apparatus according to claim 8, further comprising a step for driving said suction means when a part of said cap is in contact with said face where said discharge orifices are provided between said suction step and said cleaning step.

7. An operation method for an ink jet apparatus according to claim 1, wherein said discharge step is performed by driving energy generating means for generating energy to discharge the ink from said discharge orifices and provided along ink flow passageways communicating with said discharge orifices.

8. An operation method for an ink jet apparatus according to claim 7, wherein said energy generating means is an electrothermal converter for generating the heat energy as said energy.

9. An operation method for an ink jet apparatus according to claim 1, wherein said exhausting step is performed by sucking said ink from said discharge orifices.

10. An operation method for an ink jet apparatus according to claim 9, wherein said suction used in said exhausting step is performed with a suction pressure below 0.5 atm.

11. An operation method for an ink jet apparatus according to claim 9, wherein said exhausting step includes a plurality of suction steps with mutually different suction pressures.

12. An operation method for an ink jet apparatus according to claim 1, wherein said exhausting step is performed by driving energy generating means for generating energy to discharge the ink from said discharge orifices and provided along ink flow passageways communicating with said discharge orifices.

13. An operation method for an ink jet apparatus according to claim 12, wherein said energy generating means is an electrothermal converter for generating heat energy as said energy.

14. An operation method for an ink jet apparatus according to claim 12, wherein a driving frequency of said energy generating means in said exhausting step is lower than a driving frequency of said energy generating means in performing recording by discharging the ink from said discharge orifices.

15. An operation method for an ink jet apparatus according to claim 12, wherein said exhausting step includes a plurality of driving steps at mutually different frequencies for said energy generating means.

16. An operation method for an ink jet apparatus according to claim 12, wherein a driving frequency of said energy generating means in said exhausting step is different between the central portion and the end portion of the discharge orifice array where a plurality of discharge orifices are arranged, said discharge orifices being arranged in an array having a central portion and an end portion.

17. An operation method for an ink jet apparatus according to claim 1, wherein said exhausting step is performed by sucking said ink from said discharge orifices, and driving energy generating means for generating energy to discharge the ink from said discharge orifices and provided along ink flow passageways communicating with said discharge orifices.

18. An operation method for an ink jet apparatus according to claim 17, wherein said energy generating means is an electrothermal converter for generating heat energy as said energy.

19. An operation method for an ink jet apparatus according to claim 17, wherein said exhausting step includes a plurality of suction steps with mutually different suction forces.

20. An operation method for an ink jet apparatus according to claim 17, wherein a driving frequency of said energy generating means in said exhausting step is lower than that of said energy generating means in performing recording by discharging the ink from said discharge orifices.

21. An operation method for an ink jet apparatus according to claim 16, wherein said exhausting step includes a plurality of driving steps at mutually different frequencies for said energy generating means.

22. An operation method for an ink jet apparatus according to claim 17, wherein a driving frequency of said energy generating means in said exhausting step is different between the central portion and the end portion of the discharge orifice array where a plurality of discharge orifices are arranged, said discharge orifices being arranged in an array having a central portion and an end portion.

23. An operation method for an ink jet apparatus according to claim 17, wherein said suction used in said exhausting step is performed with a suction pressure below 0.5 atm.

24. An ink jet apparatus having discharge orifices including waterproof ink orifices for discharging waterproof ink which becomes water insoluble after drying and non-waterproof ink orifices for discharging non-waterproof ink, the apparatus comprising:

a cap for covering both said waterproof ink orifices and said non-waterproof ink orifices collectively;

suction means, connected to said cap to apply suction at an inside thereof, for effecting suction from both said waterproof ink orifices and said non-waterproof ink orifices when said cap covers both said waterproof ink orifices and said non-waterproof ink orifices collectively; and control means for causing said suction means to suck ink from both said waterproof ink orifices and said non-waterproof ink orifices when said cap covers both said waterproof ink orifices and said non-waterproof ink orifices collectively, for causing both said waterproof ink orifices and said non-waterproof ink orifices to discharge ink into said cap so that waterproof ink and non-waterproof ink are mixed in said cap, for causing said suction means to exhaust ink out of said cap when an inside of said cap communicates with air.

25. An ink jet apparatus according to claim 24, wherein both the waterproof ink which becomes water insoluble after drying and a non-waterproof ink are employed.

26. An ink jet apparatus according to claim 25, wherein said cap covers as a whole the discharge orifices for discharging said waterproof ink and the discharge orifices for discharging said non-waterproof ink.

27. An ink jet apparatus according to claim 25, wherein said waterproof ink and said non-waterproof ink are different in color.

28. An ink jet apparatus according to claim 25, wherein said waterproof ink contains urea.

29. An ink jet apparatus according to claim 24, wherein said control means effects discharge of the ink into the cap when said cap opens said discharge orifices.

30. An ink jet apparatus according to claim 24, further comprising a wiper blade for cleaning the face where said discharge orifices are provided, said discharge orifices being provided on a face of said apparatus.

31. An ink jet apparatus according to claim 24, further comprising energy generating means for generating heat energy to discharge the ink from said discharge orifices and provided along ink discharge passageways communicating with said discharge orifices.

32. An ink jet apparatus according to claim 31, wherein said energy generating means is an electrothermal converter for generating heat energy as said energy.

33. An operation method for an ink jet recording apparatus, wherein the apparatus includes discharge orifices having waterproof ink orifices for discharging waterproof ink, which becomes water-insoluble after drying, and non-waterproof ink orifices for discharging non-waterproof ink, a cap for covering both said waterproof ink orifices and said non-waterproof ink orifices collectively, and suction means for effecting suction from both said waterproof ink orifices and said non-waterproof ink orifices when said cap covers both said waterproof ink orifices and said non-waterproof ink orifices collectively, said method comprising:

a discharge step for discharging ink from both said waterproof ink orifices and said non-waterproof ink orifices into said cap so that waterproof ink and non-waterproof ink are mixed in said cap; and an exhausting step, performed after said discharge step, for exhausting ink out of said cap by driving said suction means when an inside of said cap communicates with air.

34. An operation method for an ink jet apparatus according to claim 33, wherein said waterproof ink and said non-waterproof ink are different in color.

35. An operation method for an ink jet apparatus according to claim 33, wherein said waterproof ink contains urea.

36. An operation method for an ink jet apparatus according to claim 33, wherein said discharge step is performed when said cap opens said discharge orifices.

37. An operation method for an ink jet apparatus according to claim 33, further comprising a cleaning step for cleaning the face where said discharge orifices are provided by a wiper blade between said suction step and said discharge step, said discharge orifices being provided on a face of said apparatus.

38. An operation method for an ink jet apparatus according to claim 37, further comprising a step for driving said suction means when a part of said cap is in contact with said face where said discharge orifices are provided between said suction step and said cleaning step.

39. An operation method for an ink jet apparatus according to claim 33, wherein said discharge step is performed by driving energy generating means for generating energy to discharge the ink from said discharge orifices sand provided along ink flow passageways communicating with said discharge orifices.

40. An operation method for an ink jet apparatus according to claim 39, wherein said energy generating means is an electrothermal converter for generating the heat energy as said energy.

41. An operation method for an ink jet apparatus according to claim 33, wherein said exhausting step is performed by sucking said ink from said discharge orifices.

42. An operation method for an ink jet apparatus according to claim 41, wherein said suction used in said exhausting step is performed with a suction pressure below 0.5 atm.

43. An operation method for an ink jet apparatus according to claim 41, wherein said exhausting step includes a plurality of suction steps with mutually different suction pressures.

44. An operation method for an ink jet apparatus according to claim 33, wherein said exhausting step is performed by driving energy generating means for generating energy to discharge the ink from said discharge orifices and provided along ink flow passageways communicating with said discharge orifices.

45. An operation method for an ink jet apparatus according to claim 51, wherein said energy generating means is an electrothermal converter for generating heat energy as said energy.

46. An operation method for an ink jet apparatus according to claim 44, wherein a driving frequency of said energy generating means in said exhausting step is lower than a driving frequency of said energy generating means in performing recording by discharging the ink from said discharge orifices.

47. An ink jet apparatus according to claim 46, wherein said control means effects discharge of the ink into the cap when said cap opens said discharge orifices.

48. An ink jet apparatus according to claim 46, further comprising a wiper blade for cleaning the face where said orifices are provided, said orifices being provided on a face of said apparatus.

49. An ink jet apparatus according to claim 46, further comprising energy generating means for generating heat energy to discharge the ink from said orifices and provided along ink discharge passageways communicating with said orifices.

50. An ink jet apparatus according to claim 49, wherein said energy generating means is an electrothermal converter for generating heat energy as said energy.

51. An operation method for an ink jet apparatus according to claim 44, wherein said exhausting step includes a plurality of driving steps at mutually different frequencies for said energy generating means.

52. An operation method for an ink jet apparatus according to claim 44, wherein a driving frequency of said energy generating means in said exhausting step is different between the central portion and the end portion of the discharge orifice array where a plurality of discharge orifices are arranged, said discharge orifices being arranged in an array having a central portion and an end portion.

53. An operation method for an ink jet apparatus according to claim 33, wherein said exhausting step is performed by sucking said ink from said discharge orifices, and driving energy generating means for generating energy to discharge the ink from said discharge orifices and provided along ink flow passageways communicating with said discharge orifices.

54. An operation method for an ink jet apparatus according to claim 53, wherein said energy generating means is an electrothermal converter for generating heat energy as said energy.

55. An operation method for an ink jet apparatus according to claim 53, wherein a driving frequency of said energy generating means in said exhausting step is lower than that of said energy generating means in performing recording by discharging the ink from said discharge orifices.

56. An operation method for an ink jet apparatus according to claim 53, characterized in that said exhausting step includes a plurality of driving steps at mutually different frequencies for said energy generating means.

57. An operation method for an ink jet apparatus according to claim 53, wherein a driving frequency of said energy generating means in said exhausting step is different between the central portion and the end portion of the discharge orifice array where a plurality of discharge orifices are arranged, said discharge orifices being arranged in an array having a central portion and an end portion.

58. An operation method for an ink jet apparatus according to claim 53, wherein said suction used in said exhausting step is performed with a suction pressure below 0.5 atm.

59. An operation method for an ink jet apparatus according to claim 53, wherein said exhausting step includes a plurality of suction steps with mutually different suction forces.

60. An ink jet apparatus having discharge orifices having waterproof ink orifices for discharging waterproof ink, which becomes water-insoluble after drying, and non-waterproof ink orifices for discharging non-waterproof ink, the apparatus comprising:

a cap for covering both said waterproof ink orifices and said non-waterproof ink orifices collectively;

suction means, connected to said cap to apply suction at an inside thereof, for effecting suction from both said waterproof ink orifices and said non-waterproof ink orifices when said cap covers both said waterproof ink orifices and said non-waterproof ink orifices collectively; and control means for causing both said waterproof ink orifices and said non-waterproof ink orifices to discharge ink into said cap so that waterproof ink and non-waterproof ink are mixed in said cap and then for causing said suction means to exhaust ink out of said cap when an inside of said cap communicates with air.

61. An ink jet apparatus according to claim 60, wherein both the waterproof ink which becomes water insoluble after drying and a non-waterproof ink are employed.

62. An ink jet apparatus according to claim 61, wherein said cap covers as a whole the waterproof ink orifices and the non-waterproof ink orifices.

63. An ink jet apparatus according to claim 61, wherein said waterproof ink and said non-waterproof ink are different in color.

64. An ink jet apparatus according to claim 61, wherein said waterproof ink contains urea.

65. An operation method for an ink jet recording apparatus, wherein the apparatus includes discharge orifices having waterproof ink orifices for discharging waterproof ink, which becomes water-insoluble after drying, and non-waterproof ink orifices for discharging non-waterproof ink, a cap for covering said discharge orifices, and suction means for effecting suction through said discharge orifices when said cap covers said discharge orifices, said method comprising:

a covering step for covering both said waterproof ink orifices and said non-waterproof ink orifices collectively by said cap;

a suction step for effecting suction through both said waterproof ink orifices and said non-waterproof ink orifices by driving said suction means when said cap covers both said waterproof ink orifices and said non-waterproof ink orifices collectively so that waterproof ink and non-waterproof ink are mixed in said cap; and an exhausting step, performed after said suction step, for exhausting ink out of said cap by driving said suction means when an inside of said cap communicates with air.

66. An operation method for an ink jet apparatus according to claim 65, wherein said waterproof ink and said non-waterproof ink are different in color.

67. An operation method for an ink jet apparatus according to claim 65, wherein said waterproof ink contains urea.

68. An operation method for an ink jet apparatus according to claim 65, further comprising a cleaning step for cleaning the face where said discharge orifices are provided by a wiper blade after said suction step, said discharge orifices being provided on a face of said apparatus.

69. An operation method for an ink jet apparatus according to claim 68, further comprising a step for driving said suction means when a part of said cap is in contact with said face where said discharge orifices are provided between said suction step and said cleaning step.

70. An operation method for an ink jet apparatus according to claim 65, wherein said exhausting step is performed by sucking said ink from said discharge orifices.

71. An operation method for an ink jet apparatus according to claim 70, wherein said suction used in said exhausting step is performed with a suction pressure below 0.5 atm.

72. An operation method for an ink jet apparatus according to claim 70, wherein said exhausting step includes a plurality of suction steps with mutually different suction pressures.

73. An operation method for an ink jet apparatus according to claim 65, wherein said exhausting step is performed by driving energy generating means for generating energy to discharge the ink from said discharge orifices and provided along ink flow passageways communicating with said discharge orifices.

74. An operation method for an ink jet apparatus according to claim 73, wherein said energy generating means is an electrothermal converter for generating heat energy as said energy.

75. An operation method for an ink jet apparatus according to claim 73, wherein a driving frequency of said energy generating means in said exhausting step is lower than a driving frequency of said energy generating means in performing recording by discharging the ink from said discharge orifices.

76. An operation method for an ink jet apparatus according to claim 73, wherein said exhausting step includes a plurality of driving steps at mutually different frequencies for said energy generating means.

77. An operation method for an ink jet apparatus according to claim 73, wherein a driving frequency of said energy generating means in said exhausting step is different between the central portion and the end portion of the discharge orifice array where a plurality of discharge orifices are arranged, said discharge orifices being arranged in an array having a central portion and an end portion.

78. An operation method for an ink jet apparatus according to claim 65, wherein said exhausting step is performed by sucking said ink from said discharge orifices, and driving energy generating means for generating energy to discharge the ink from said discharge orifices and provided along ink flow passageways communicating with said discharge orifices.

79. An operation method for an ink jet apparatus according to claim 78, wherein said energy generating means is an electrothermal converter for generating heat energy as said energy.

80. An operation method for an ink jet apparatus according to claim 78, wherein a driving frequency of said energy generating means in said exhausting step is lower than that of said energy generating means in performing recording by discharging the ink from said discharge orifices.

81. An operation method for an ink jet apparatus according to claim 78, characterized in that said exhausting step includes a plurality of driving steps at mutually different frequencies for said energy generating means.

82. An operation method for an ink jet apparatus according to claim 78, wherein a driving frequency of said energy generating means in said exhausting step is different between the central portion and the end portion of the discharge orifice array where a plurality of discharge orifices are arranged, said discharge orifices being arranged in an array having a central portion and an end portion.

83. An operation method for an ink jet apparatus according to claim 78, wherein said suction used in said exhausting step is performed with a suction pressure below 0.5 atm.

84. An operation method for an ink jet apparatus according to claim 78, wherein said exhausting step includes a plurality of suction steps with mutually different suction forces.

85. An ink jet apparatus having discharge orifices having waterproof ink orifices for discharging waterproof ink which becomes water-insoluble after drying and non-waterproof ink orifices for discharging non-waterproof ink, the apparatus comprising:

a cap for covering both said waterproof ink orifices and said non-waterproof ink orifices collectively;

suction means, connected to said cap to apply suction at an inside thereof, for effecting suction from both said waterproof ink orifices and said non-waterproof ink orifices when said cap covers both said waterproof ink orifices and said non-waterproof ink orifices collectively; and control means for causing said suction means to suck ink from both said waterproof ink orifices and said non-waterproof ink orifices when said cap covers both said waterproof ink orifices and said non-waterproof ink orifices collectively so that waterproof ink and non-waterproof ink are mixed in said cap and then for causing said suction means to exhaust ink out of said cap when an inside of said cap communicates with air.

86. An ink jet apparatus according to claim 85, wherein both the waterproof ink which becomes water insoluble after drying and a non-waterproof ink are employed.

87. An ink jet apparatus according to claim 86, wherein said cap covers as a whole the waterproof ink orifices and the non-waterproof ink orifices.

88. An ink jet apparatus according to claim 86, wherein said waterproof ink and said non-waterproof ink are different in color.

89. An ink jet apparatus according to claim 86, wherein said waterproof ink contains urea.

90. An ink jet apparatus according to claim 85, wherein said control means effects discharge of the ink into the cap when said cap opens said discharge orifices.

91. An ink jet apparatus according to claim 85, further comprising a wiper blade for cleaning the face where said orifices are provided, said orifices being provided on a face of said apparatus.

92. An ink jet apparatus according to claim 85, further comprising energy generating means for generating heat energy to discharge the ink from said orifices and provided along ink discharge passageways communicating with said orifices.

93. An ink jet apparatus according to claim 92, wherein said energy generating means is an electrothermal converter for generating heat energy as said energy.

* * * * *

UNITED STATES PATENT AND TRADEMARK OFFICE

CERTIFICATE OF CORRECTION

PATENT NO. : 6,447,095 B1
DATED : September 10, 2002
INVENTOR(S) : Kanda et al.

It is certified that error appears in the above-identified patent and that said Letters Patent is hereby corrected as shown below:

Title page,
Item [56], References Cited, FOREIGN PATENT DOCUMENTS,
"DE 4207625" should read -- DE004207625 --;
"JP 06191033" should read -- JP 6-191033 --; and
"JP 406191034" should read -- JP 6-191034 --.

Drawings,
Sheet 9, Figure 11, in box labeled "415", "circit" should read -- circuit --.

Column 4,
Line 48, "apparatus" should read -- apparent --.

Column 6,
Line 48, "124g. 125" should read -- 124g. ¶125 --; and
Line 55, "shaft. 127" should read -- shaft. ¶127 --.

Column 7,
Line 2, "124. 132" should read -- 124. ¶ 132 --;
Line 15, "not shown" should read -- (not shown) --; and
Line 38, "A1," should read -- Δ1, --.

Column 8,
Line 11, "gloycol" should read -- glycol --.

Column 10,
Line 7, "motor, not shown." should read -- motor (not shown). --;
Line 35, "not shown" should read -- (not shown) --; and
Line 55, "sensors" should read -- sensor --.

Column 11,
Line 25, "Also, a" should read -- A --.

Column 13,
Lines 14 and 15, "short" should read -- a short --; and
Line 30, "by" should be deleted.

UNITED STATES PATENT AND TRADEMARK OFFICE

CERTIFICATE OF CORRECTION

PATENT NO. : 6,447,095 B1
DATED : September 10, 2002
INVENTOR(S) : Kanda et al.

It is certified that error appears in the above-identified patent and that said Letters Patent is hereby corrected as shown below:

Column 14,
Lines 4, 5, 50 and 51, “short” should read -- a short --.

Column 16,
Line 6, “claim 8,” should read -- claim 5, --.

Column 17,
Line 10, “claim 16,” should read -- claim 17, --.

Column 18,
Line 48, “sand” should read -- and --.

Column 19,
Line 5, “claim 51,” should read -- claim 44, --.

Signed and Sealed this

Twenty-second Day of April, 2003

JAMES E. ROGAN
*Director of the United States Patent and Trademark Office*